US005503325A

United States Patent [19]

Nelson et al.

[11] Patent Number: 5,503,325

[45] Date of Patent: Apr. 2, 1996

[54] PRETAPED CONTAINER BLANKS

[75] Inventors: Thomas L. Nelson, Woodbury, Minn.; Eugene L. Baratto, Somerset, Wis.; John R. David, Stillwater, Minn.; Curtis L. Larson, Hudson, Wis.; Norbert E. Wrobel, Marine-on-the-St. Croix, Minn.

[73] Assignee: Minnesota Mining and Manufacturing Company, Saint Paul, Minn.

[21] Appl. No.: 319,829

[22] Filed: Oct. 7, 1994

Related U.S. Application Data

[63] Continuation-in-part of Ser. No. 372,850, Jan. 13, 1995, Pat. No. 5,465,900, which is a continuation of Ser. No. 132,805, Oct. 7, 1993, abandoned.

[51] Int. Cl.[6] ..... B65D 5/42

[52] U.S. Cl. ..... 229/125.39; 229/115; 229/148; 229/151; 229/123.1

[58] Field of Search ..... 229/125.37, 183, 229/924, 123.1, 115, 148, 101, 921, 125.39; 383/71; 206/813

[56] References Cited

U.S. PATENT DOCUMENTS

| | | | |
|---|---|---|---|
| Re. 26,742 | 12/1969 | Laskow | 229/132 |
| 1,076,897 | 10/1913 | Lettré | 229/125.39 |
| 1,364,225 | 1/1921 | Webb | 229/125.39 |
| 1,532,900 | 4/1925 | Houghland | 229/921 |
| 1,551,268 | 8/1925 | Scott | 229/148 |
| 1,986,145 | 1/1935 | Goodyear | 229/151 |
| 1,987,545 | 1/1935 | Alexander . | |
| 2,052,977 | 9/1936 | Hofmann | 229/123.1 |
| 2,063,999 | 12/1936 | Harrison | 229/125.39 |
| 2,179,731 | 11/1939 | Saylor | 229/151 |
| 2,188,039 | 1/1940 | Farmer | 229/62 |
| 2,400,406 | 5/1946 | Godoy | 229/123.1 |
| 2,625,316 | 1/1953 | Stortz | 229/921 |
| 2,828,905 | 6/1956 | Frizzell . | |
| 2,896,836 | 7/1959 | Bergstein . | |
| 2,998,180 | 3/1959 | Dehoney, Jr. . | |
| 3,064,876 | 2/1961 | Warner . | |
| 3,178,095 | 4/1965 | Hennefent | 229/125.39 |
| 3,276,664 | 10/1965 | Johnson . | |
| 3,345,920 | 10/1967 | Jordan . | |
| 3,550,834 | 12/1970 | McCall | 229/115 |
| 3,608,707 | 9/1971 | Miller | 229/125.39 |
| 3,616,114 | 10/1971 | Hamaguchi . | |
| 4,433,780 | 2/1984 | Ellis | 229/921 |
| 4,557,971 | 12/1985 | Williams | 229/125.39 |

(List continued on next page.)

FOREIGN PATENT DOCUMENTS

| | | |
|---|---|---|
| 861580 | 2/1941 | France . |
| 2701453 | 8/1994 | France . |

OTHER PUBLICATIONS

Hanlon, Joseph F. *Handbook of Package Engineering*, Second Edition, 1984, McGraw Hill Book Company (pp. 14–1 to 14–18).

Five photographs of a packaging kit marketed by Swiss Post Office (no date).

*Primary Examiner*—Gary E. Elkins

*Attorney, Agent, or Firm*—Gary L. Griswold; Walter N. Kirn; James J. Trussell

[57] ABSTRACT

A pretaped container blank which may be quickly and easily formed into a three-dimensional container without the need for additional components or tools. The container blank includes (i) a plurality of interconnected panels, and (ii) a plurality of closure flaps including a carrier flap hingedly connected to at least one of the panels. The tape structure is attached to the container blank and includes (i) a release surface on the carrier flap, and (ii) a length of closure adhesive tape extending over substantially the entire length of the release surface and a distance across the panel or flap to which the carrier flap is connected sufficient for the tape to remain attached to the container blank upon removal of that length of the tape from the release surface. Several embodiments of container blanks and tape structures are disclosed.

6 Claims, 14 Drawing Sheets

U.S. PATENT DOCUMENTS

| | | | |
|---|---|---|---|
| 4,741,935 | 5/1988 | Sheehan, Jr. | 229/125.39 |
| 4,763,789 | 8/1988 | Questel et al. | 229/148 |
| 5,079,900 | 1/1992 | Pinckney et al. | 53/413 |
| 5,184,997 | 2/1993 | James et al. | 229/125.39 |
| 5,186,542 | 2/1993 | Seabold | 383/25 |
| 5,213,254 | 5/1993 | Regis et al. | 229/151 |
| 5,353,575 | 10/1994 | Stepanek | 53/461 |

PRETAPED CONTAINER BLANKS

This is a continuation-in-part of application Ser. No. 08/372,850, filed Jan. 13, 1995, U.S. Pat. No. 5,465,900 which is a continuation of application Ser. No. 08/132,805 filed Oct. 7, 1993, now abandoned.

FIELD OF THE INVENTION

The invention relates to corrugated fiberboard and paperboard containers and systems for erecting a three-dimensional container from a container blank or a collapsed container structure.

BACKGROUND

Cardboard containers are frequently erected from collapsed container structures by securing pressure sensitive box sealing tape along the seams between the closed side flaps. The tape is generally applied from a roll using automatic dispensing and taping equipment or a manually operable hand-held dispenser. Those who have attempted to perform the seemingly simple task of manually erecting a container structure and securing it with tape will attest to the fact that a certain level of skill and dexterity is required to retain the flaps in proper alignment while dispensing and applying the tape. An additional problem encountered by those who only occasionally erect such containers is that—in accordance with Murphy's Law—the roll of tape and dispensing tool are never to be found when they are needed.

Several efforts have been made to provide a fully self-contained container which is simple to assemble and does not require the use of additional tools.

U.S. Pat. No. 2,998,180 issued to Dehoney, Jr. discloses a self-sealing container wherein the exterior surface of one side closure flap at each end of the container is completely coated with an aggressive pressure sensitive adhesive covered with a release liner. The container is assembled at each end by folding the end flaps, folding the adhesive-coated side flap, removing the release liner, and folding the other side flap into adhesive engagement with the adhesive-coated side flap. While generally effective as a self-closing container, the container requires the use of substantial quantities of pressure sensitive adhesive, disposal of a sizable amount of release liner, and does not work with regular slotted containers (RSC) because of the need for fully overlapping side flaps.

U.S. Pat. Nos. 3,276,664, issued to Johnson, and 2,896,836, issued to Bergstein, disclose self-sealing containers wherein the overlapping surfaces of closure flaps are pattern coated with an aggressive cohesive adhesive (bonds only to itself). The container is assembled at each end by first folding the end flaps and then folding the side flaps into adhesive engagement with the end flaps (Johnson) or each other (Bergstein). Those areas where the adhesive overlaps causes the flaps to bond together and thereby close the container. While generally effective as self-closing containers, the containers require that the adhesive be imaged onto the container within close tolerance levels to avoid premature bonding of the flaps and is subject to premature bonding of the individual flaps of a single container and the flaps of multiple containers due to shifting of the collapsed containers during shipping and handling. In addition, the fully assembled container is not sealed along the seam where the flaps come together and is subject to the introduction of contaminants into the container.

U.S. Pat. No. 3,345,920, issued to Jordan discloses a self-sealing container wherein paired adhesive coated strips are attached to the underside of each of the innermost flaps. The strips extend upward through a slot in the innermost flaps positioned at the juncture of the outermost flaps for adhesively bonding to the exterior surface of each of the outermost flaps. While generally effective as a self-closing container, the positioning of the adhesive strips produces a weakly bonded container.

While these configurations are generally acceptable for limited uses, a need continues to exist for a reliable, high quality, inexpensive, self-contained collapsed container which is simple and easy to assemble and seal.

SUMMARY OF THE INVENTION

We have discovered a self-contained container assembly which may be quickly and easily formed into a three-dimensional container and sealed without the need for additional components or tools. The container assembly includes a container blank and a tape structure. The container blank can be of any desired configuration, including, but not limited to, regular slotted container (RSC), die-cut diskette or book box, die-cut tuck in box, die-cut locking tab box, and three-sided tube mailer.

The RSC container blank includes (i) a plurality of laterally interconnected panels, and (ii) a set of closure flaps hingedly connected to the longitudinal edges of the panels at one end. The tape structure is attached to the container blank and includes (i) a release surface extending longitudinally along a first of the closure flaps from proximate the panel to which the closure flap is connected to proximate the distal edge of the closure flap, and (ii) a length of closure adhesive tape extending over substantially the entire length of the first closure flap—in overlapping relationship to the release surface—and a distance across the panel to which the first closure flap is connected sufficient for the tape to remain attached to the container blank upon removal of that length of the tape extending across the first closure flap.

The tape structure is positioned along the width of the first closure flap so that the closure adhesive tape can secure the first set of closure flaps in an overlapping closed position by peeling the tape from the primary closure flap, folding the closure flaps in an overlapping relationship with the closure flaps positioned immediately to either side of the first closure flap closed last, and the closure tape adhesively applied over its original position on the first closure flap.

When the RSC container blank forms a rectangular container with a pair of assembly opposed end flaps and a pair of assembly opposed side flaps, the container assembly can include multiple tape structures on each end flap. The tape structures are laterally positioned on the end flaps to cover imaginary longitudinal lines extending inward from the side edges of each end flap a distance equal to the length of the side flap located proximate that side of the end flap. Such a lateral positioning locates the closure tape along the seam formed between the pair of side flaps when the container is formed and the flaps are folded inward to close the end of the container.

The die-cut diskette/book container blank can be modified by varying the dimensions of particular elements to tailor the container size to the intended content. The die-cut diskette/book container blanks include (i) a plurality of panels which, when assembled, form the bottom, front, back and sides of the container, (ii) a top flap hingedly connected to the back panel and a front flap hingedly connected to the top flap for closing the assembled container, and (iii) a pair of insert flaps hingedly connected to the front flap for insertion in a pair of slots formed by the side panels when the container blank is assembled. The tape structure is attached to the container blank and includes (i) a release surface extending along the inner surface of the front flap, and (ii) a length of closure adhesive tape extending over substantially the entire length of the release surface and continuing a distance across the outer surface of the front flap sufficient for the tape to remain attached to the container blank upon removal of that length of the tape extending across the release surface.

The tape structure is positioned such that when the die-cut diskette/box container blank is assembled, the closure adhesive tape is removed from the inside surface of the front flap, the front flap is then placed over the front panel with the insert flaps tucked into the slots formed on the side panels, and the adhesive closure tape is then adhered to the bottom panel of the container, thereby sealing the container.

The die-cut tuck in container blank includes (i) a plurality of panels which, when assembled, form the bottom, front, back and sides of the container, and (ii) a top flap hingedly connected to the back panel and a tuck flap hingedly connected to the front flap for closing the assembled container by tucking the tuck flap inside the assembled container adjacent to the front panel. The tape structure is attached to the container blank and includes (i) a release surface extending along the outer surface of the tuck flap and optionally continuing onto the inner surface, and (ii) a length of closure adhesive tape extending over substantially the entire length of the release surface and continuing a distance across the outer surface of the top flap sufficient for the tape to remain attached to the container blank upon removal of that length of the tape extending across the release surface.

The tape structure is positioned such that when the die-cut tuck in container blank is assembled, the closure adhesive tape is removed from the outer surface of the tuck flap, the top flap is then placed over the opening of the container formed by the panels, the tuck flap is tucked inside the container adjacent the front panel, and the adhesive closure tape is then adhered to the front panel of the container, thereby sealing the container.

The die-cut locking tab container blank includes (i) a plurality of panels which, when assembled, form the bottom, top, back and front of the container which has first and second open ends, (ii) first and second end flaps and first and second closure flaps hingedly connected to the panels for closing the first and second openings when the container blank is assembled, and (iii) first and second locking tabs hingedly connected to the top container panel and configured to be inserted into the first and second closure flaps, respectively, for locking the assembled container closed. The tape structure is attached to the container blank and includes (i) a release surface extending along the outer surface of the locking tabs and optionally continuing onto the inner surface, and (ii) a length of closure adhesive tape extending over substantially the entire length of the release surface and continuing a distance onto the outer surface of the top panel sufficient for the tape to remain attached to the container blank upon removal of that length of the tape extending across the release surface.

The tape structure is positioned such that when the die-cut locking tab container blank is assembled, the closure adhesive tape is removed from the outer surface of the locking tabs, the locking tabs are then inserted in slots in the closure flaps, and the adhesive closure tape is then adhered to closure flaps, thereby sealing the container.

The three-sided tube box includes (i) a plurality of laterally connected panels which, when assembled, form the sides of a triangular container which has first and second open ends, and (ii) a plurality of closure flaps hingedly connected to the panels for closing the first and second openings when the container blank is assembled. A panel tape structure is attached to the container blank and includes (i) a release surface extending along the inner surface of one of the panels, and (ii) a length of closure adhesive tape extending over substantially the entire length of the release surface and continuing a distance onto the outer surface of top panel sufficient for the tape to remain attached to the container blank upon removal of that length of the tape extending across the release surface. A flap tape structure includes (i) a release surface extending along the outer surface of a closure flap, and (ii) a length of closure adhesive tape extending over substantially the entire length of the release surface and continuing a distance onto the adjacent panel sufficient for the tape to remain attached to the container blank upon removal of that length of tape extending across the release surface.

The panel tape structure is positioned such that when the panels of the three sided tube box are assembled, the closure adhesive tape is removed from the inner surface of one end panel and is securely adhered to another panel, thereby forming an open-ended tube box. The flap tape structure is positioned such the closure adhesive tape is peeled from one of the closure flaps, the other closure flaps are folded over one end opening in overlapping relationship with a closure flap having no tape structure being folded over last, with the adhesive tape then securely adhered to the last closed flap thereby sealing closed the end opening of the container.

Figure 1:
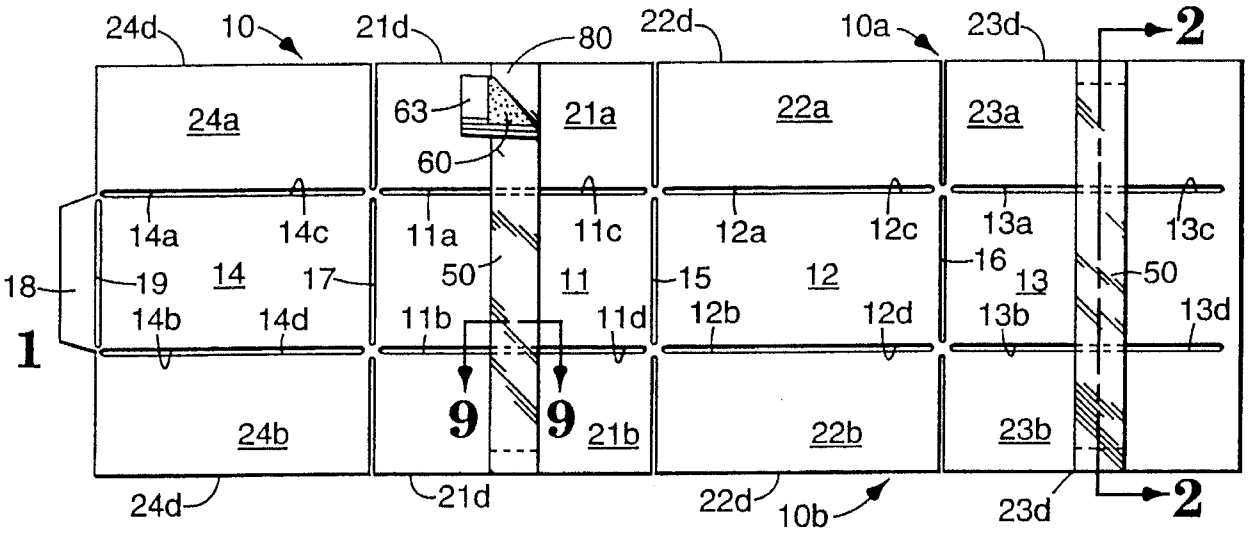
FIG. 1 is a plan view of a regular slotted container embodiment of the pretaped container blank of this invention including a first embodiment of a tape structure.

FIG. **9*a* is a cross-sectional view of the pretaped container blank of FIG. 1 taken along line 9—9** showing the layers of the container, target tape adhesive, target tape backing, closure tape adhesive and closure tape backing.

Figure 9A:
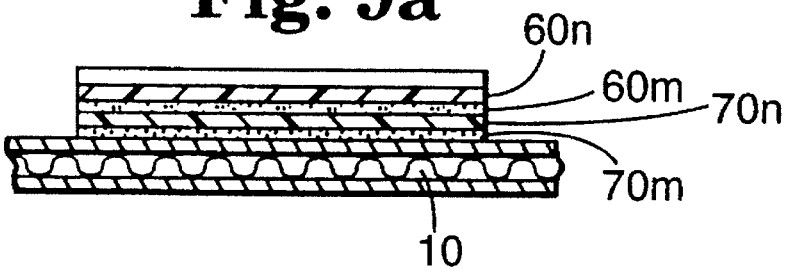
Figure 9B:
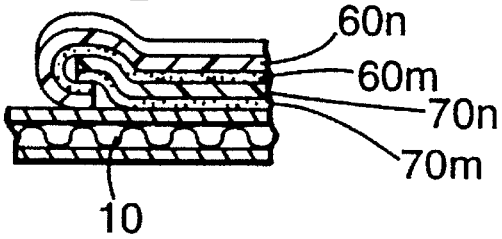

FIG. 9*b* is a view like FIG. 9*a*, showing an alternate arrangement of the closure tape and target tape.

Figure 9C:
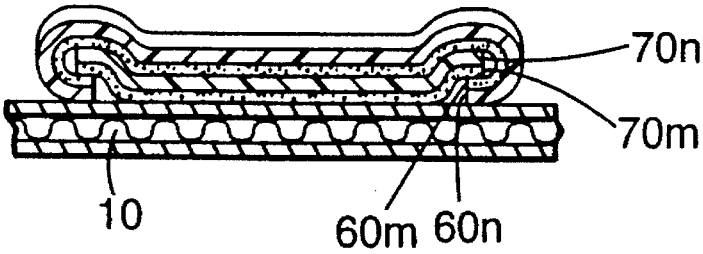

FIG. 9*c* is a view like FIG. 9*b*, showing another alternate arrangement of the closure tape and target tape.

Figure 10:
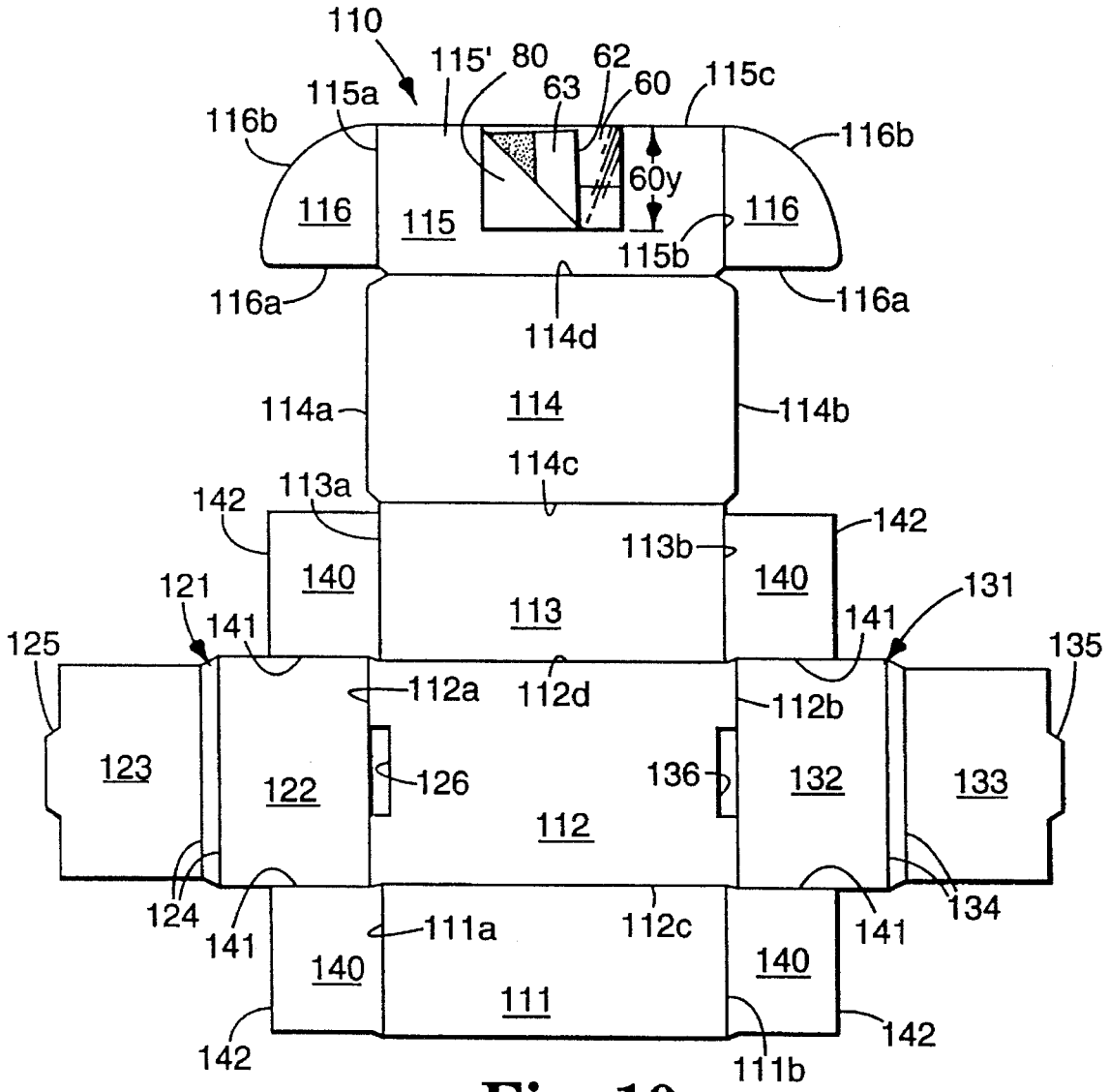

FIG. 10 is a plan view of the die-cut diskette/book embodiment of the pretaped container blank of this invention including a second embodiment of a tape structure.

Figure 11:
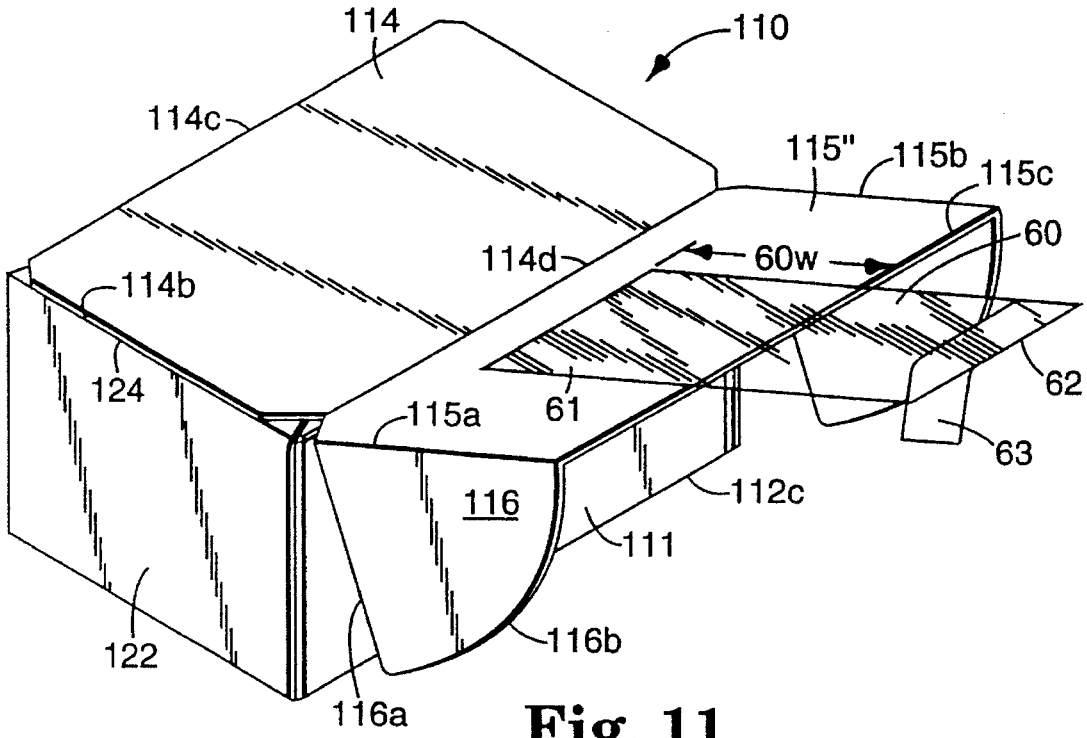

FIG. 11 is a partially assembled perspective view of the pretaped container blank of FIG. 10.

Figure 12:
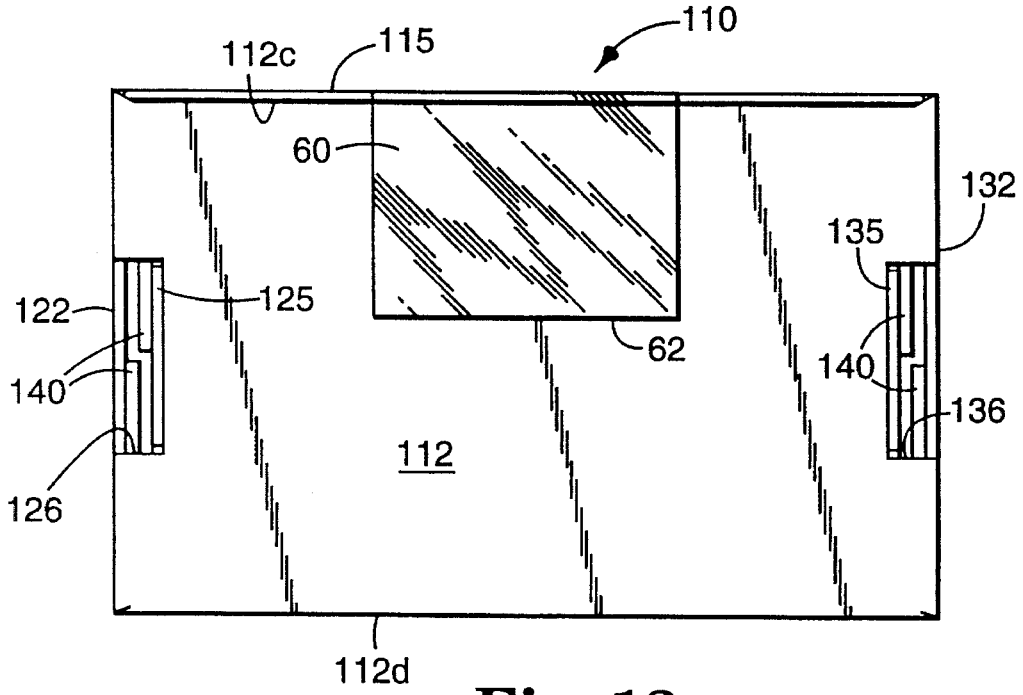

FIG. 12 is a bottom plan view of the assembled and sealed container blank of FIG. 10.

Figure 13:
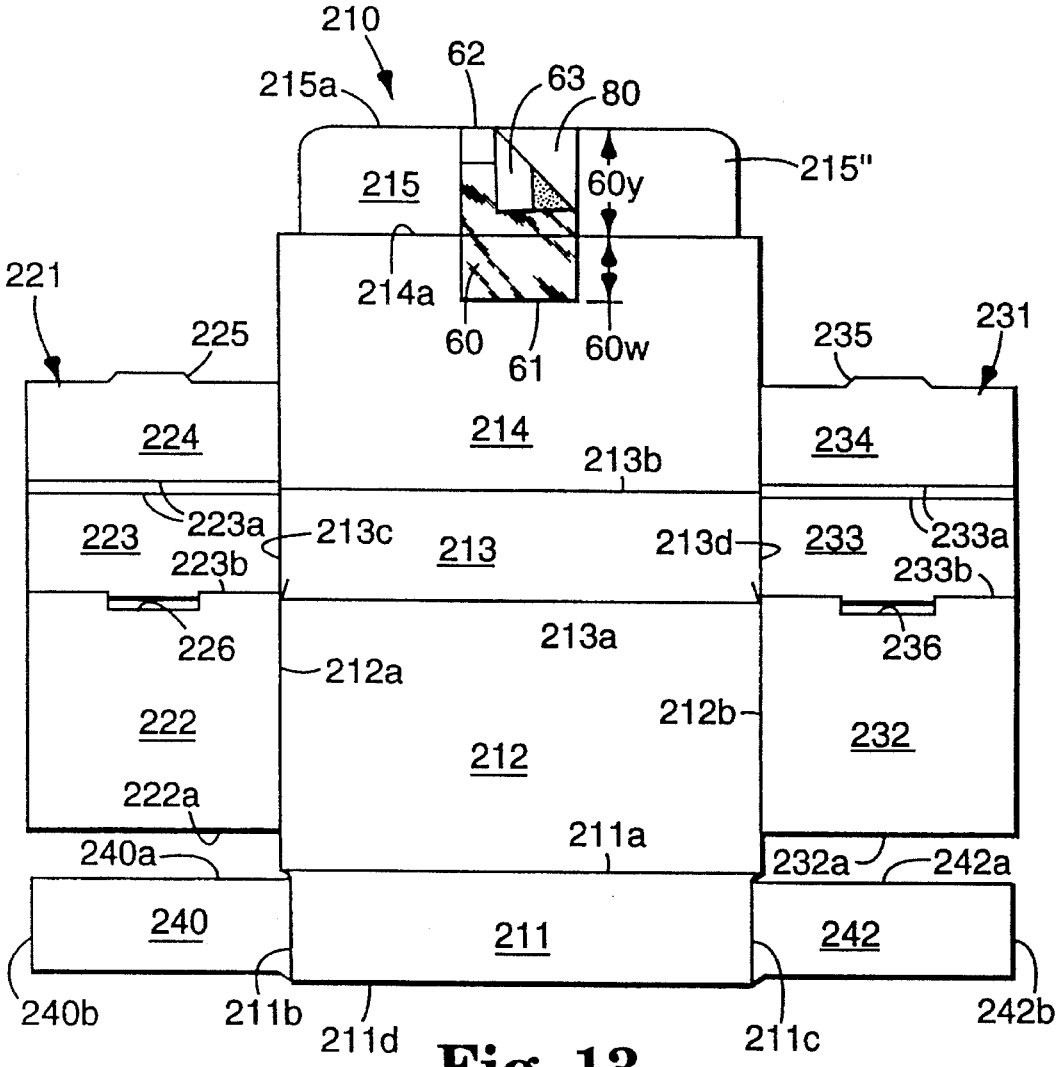

FIG. 13 is a plan view of the die-cut tuck in embodiment of the pretaped container blank of this invention including a second embodiment of a tape structure.

Figure 14:
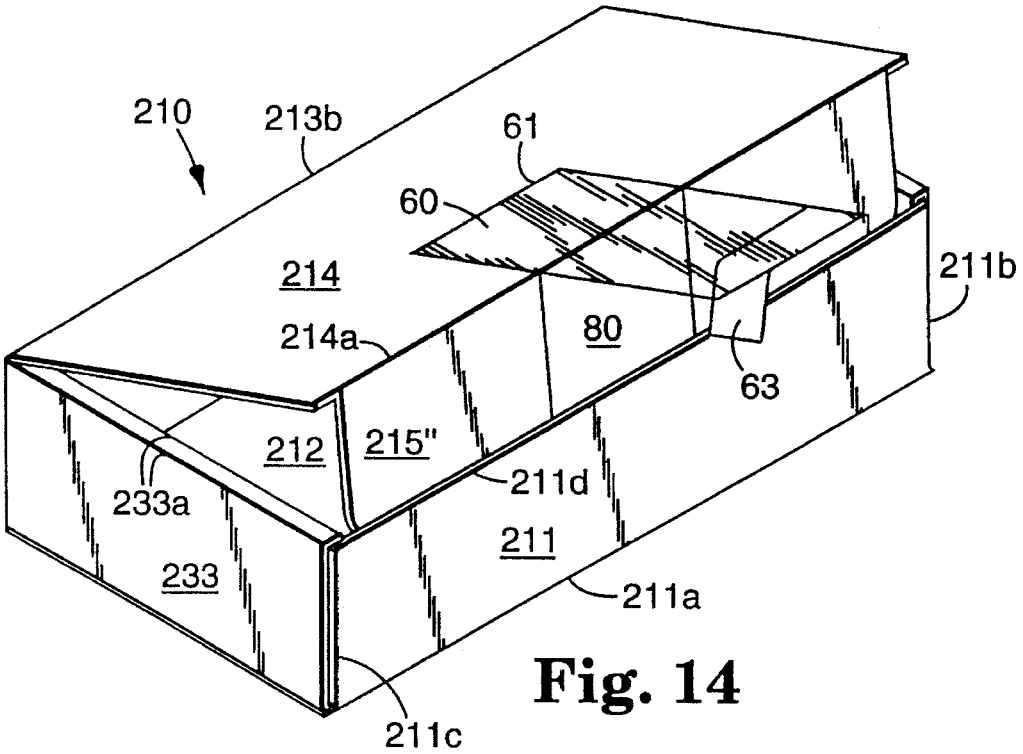

FIG. 14 is a partially assembled perspective view of the pretaped container blank of FIG. 13.

Figure 15:
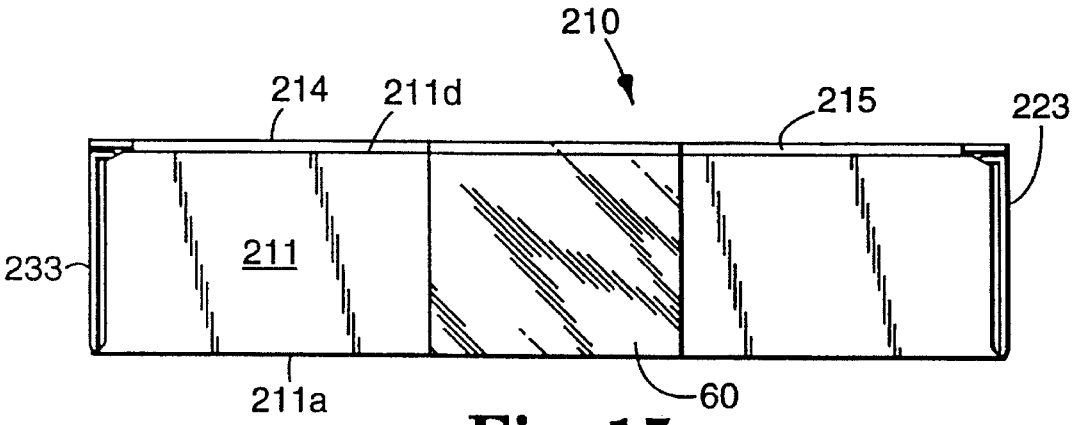

FIG. 15 is a front elevational view of the assembled and sealed container blank of FIG. 13.

Figure 16:
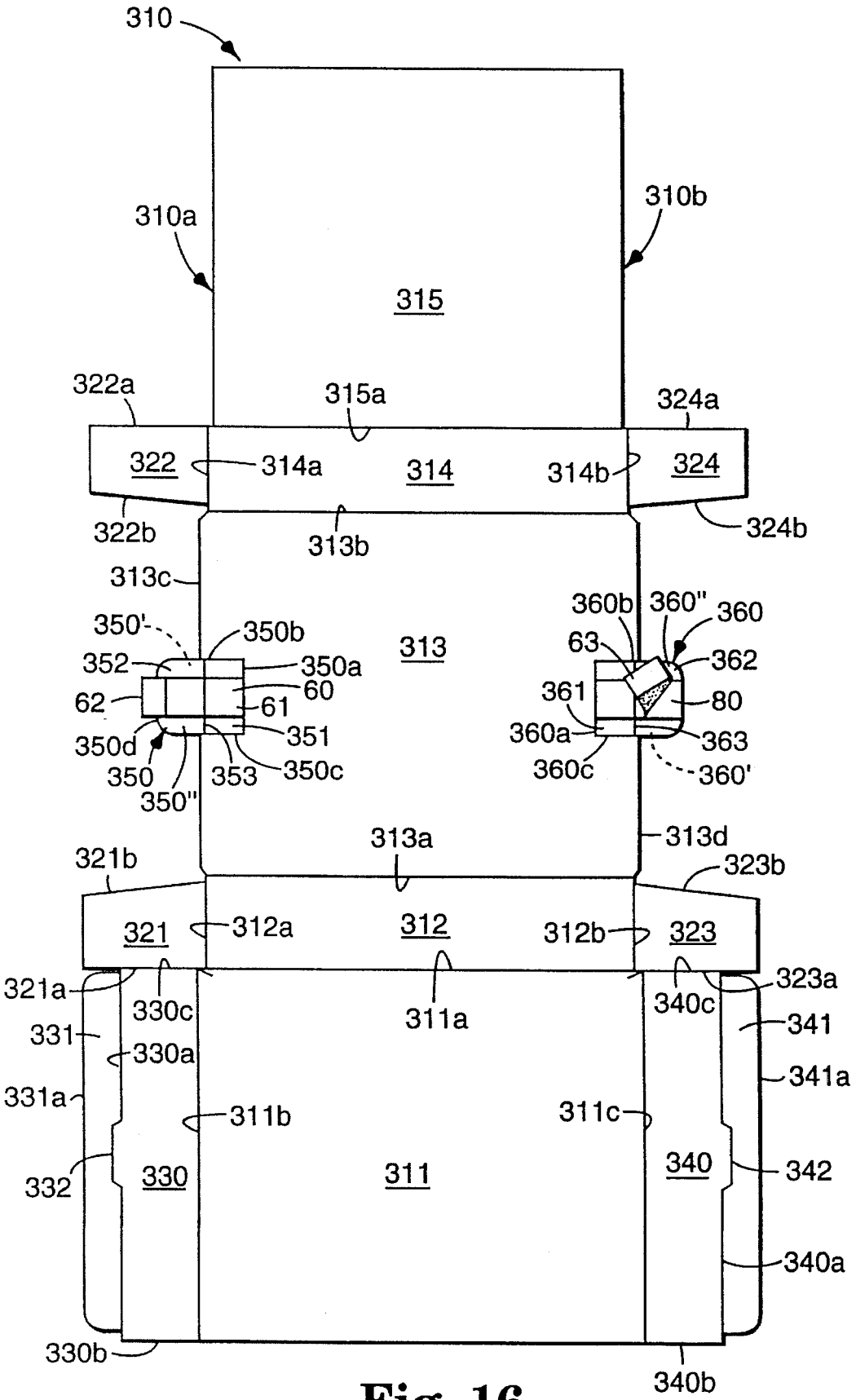

FIG. 16 is a plan view of the die-cut locking tab embodiment of the pretaped container blank of this invention including a second embodiment of a tape structure.

Figure 17:
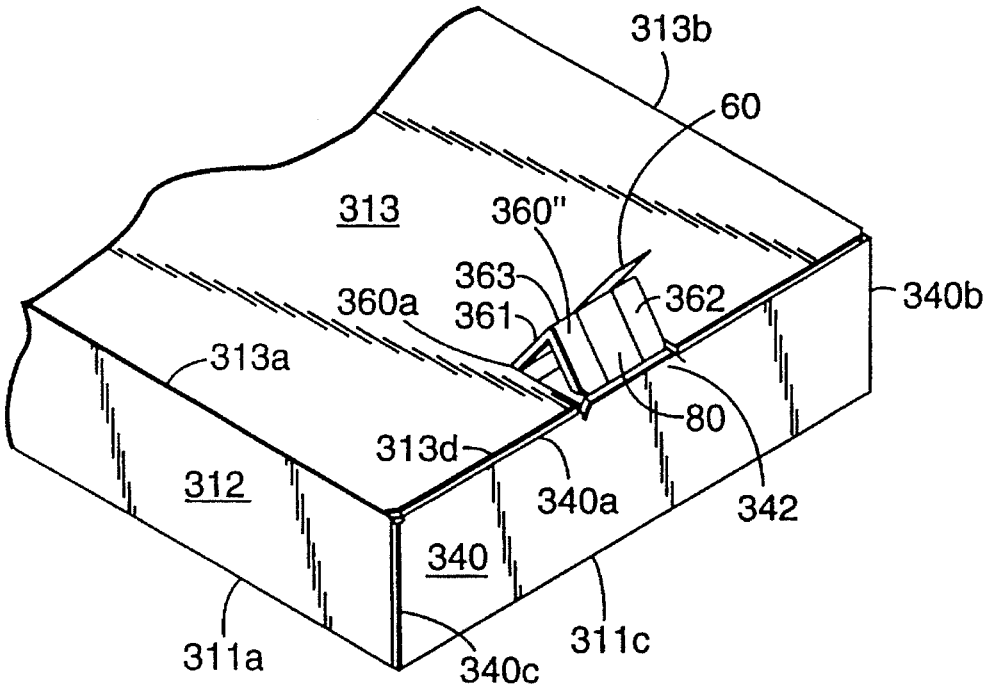

FIG. 17 is a partially assembled perspective view of the pretaped container blank of FIG. 13.

Figure 18:
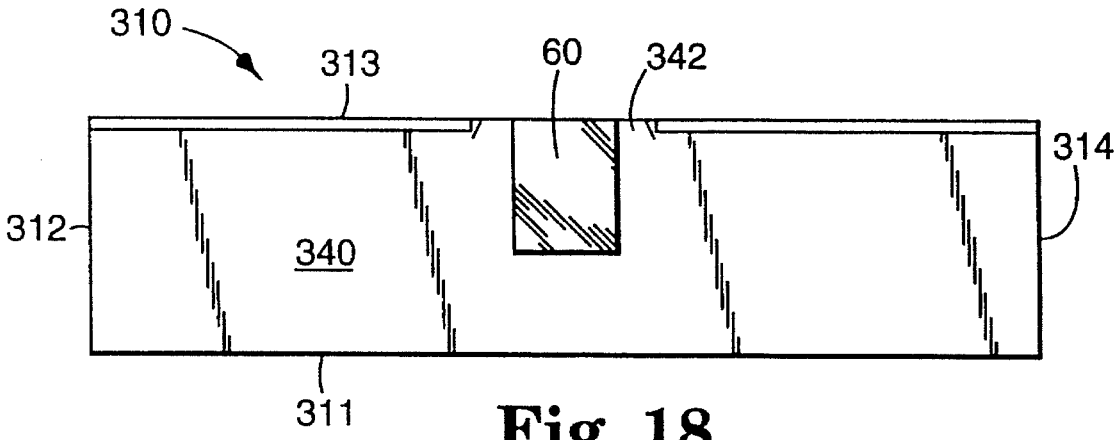

FIG. 18 is a side elevational view of the assembled and sealed container blank of FIG. 16.

Figure 19:
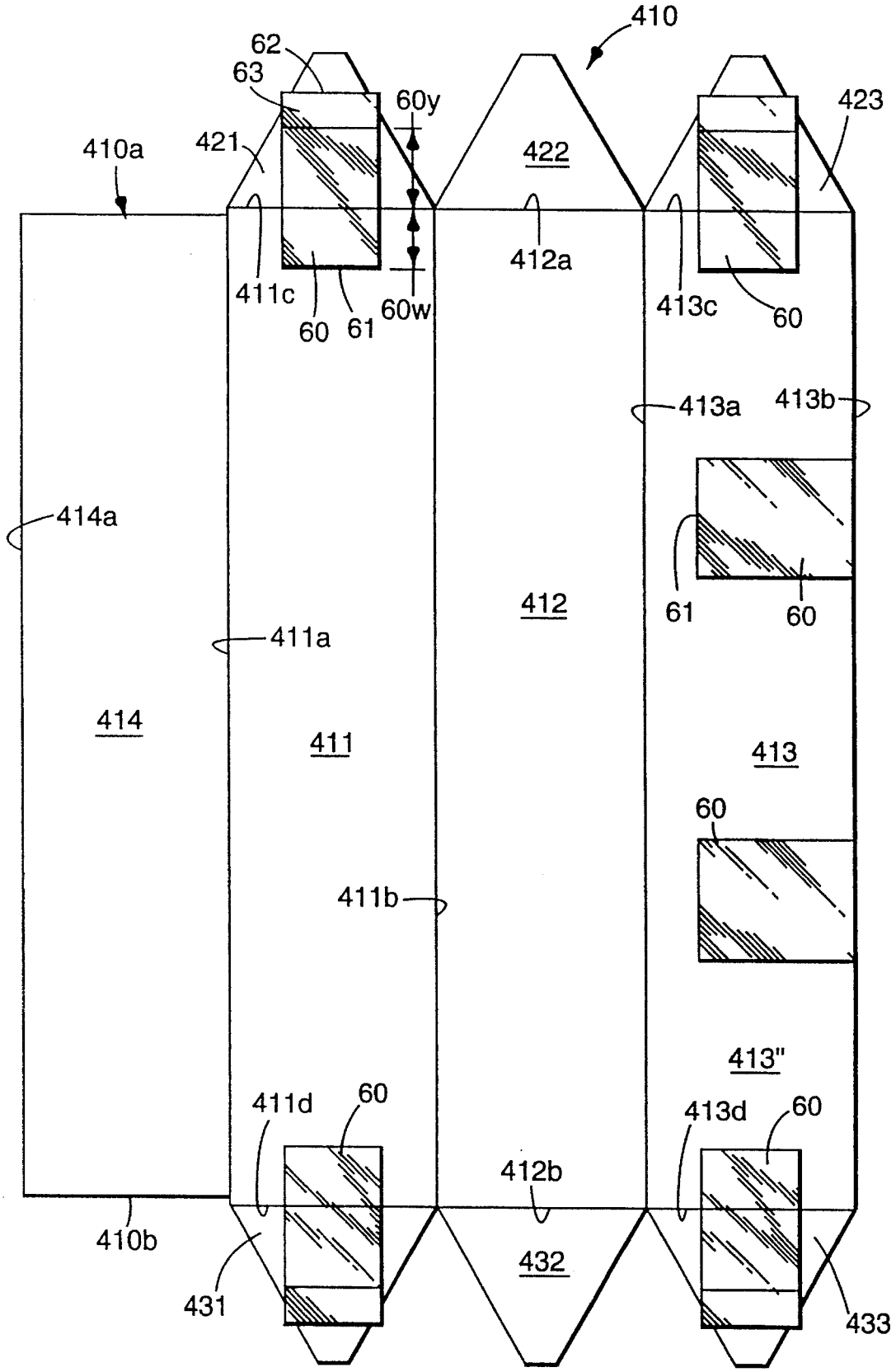

FIG. 19 is a plan view of the three sided tube mailer embodiment of the pretaped container blank of this invention including a second embodiment of a tape structure.

Figure 20:
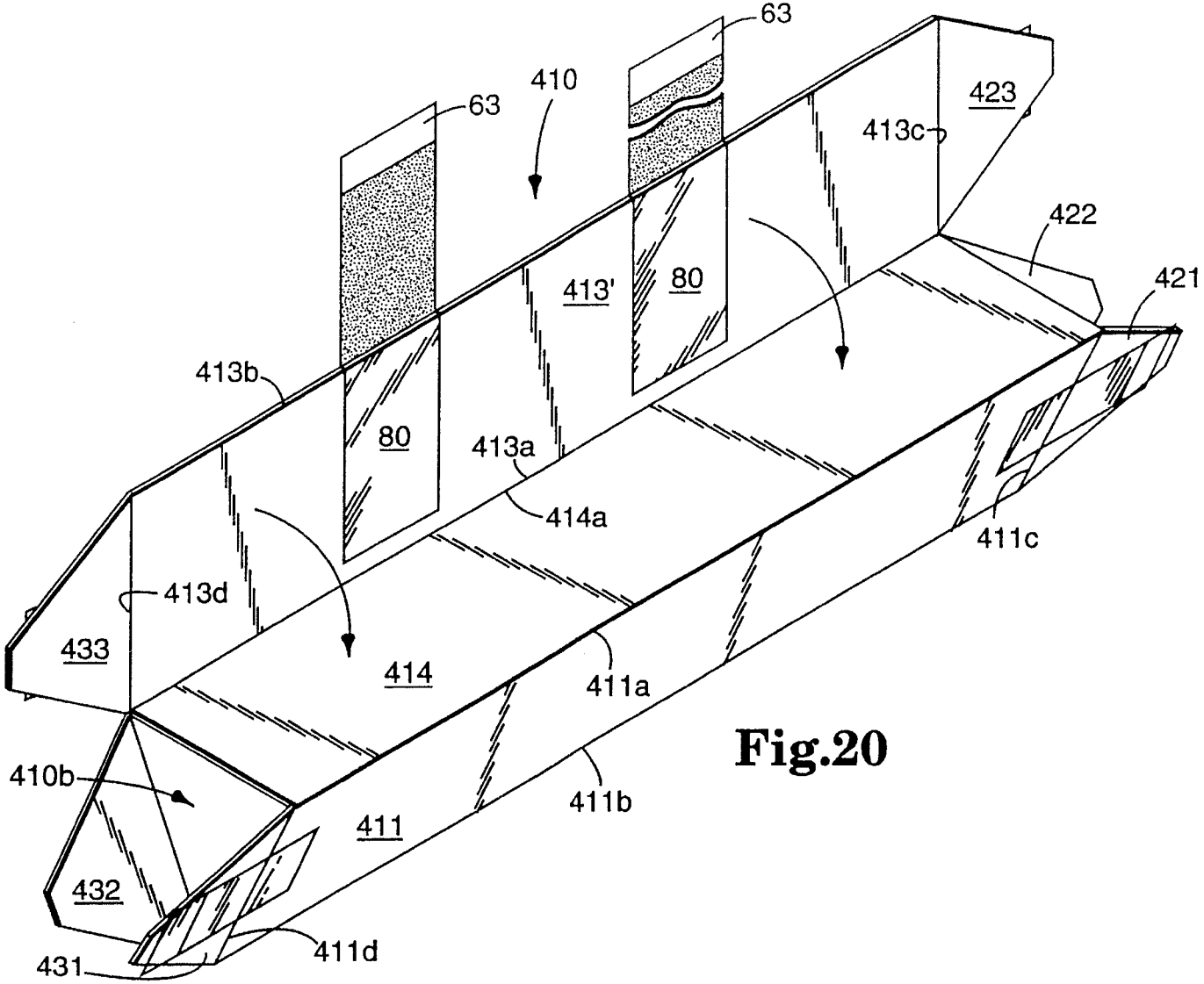

FIG. 20 is a partially assembled perspective view of the pretaped container blank of FIG. 19.

Figure 21:
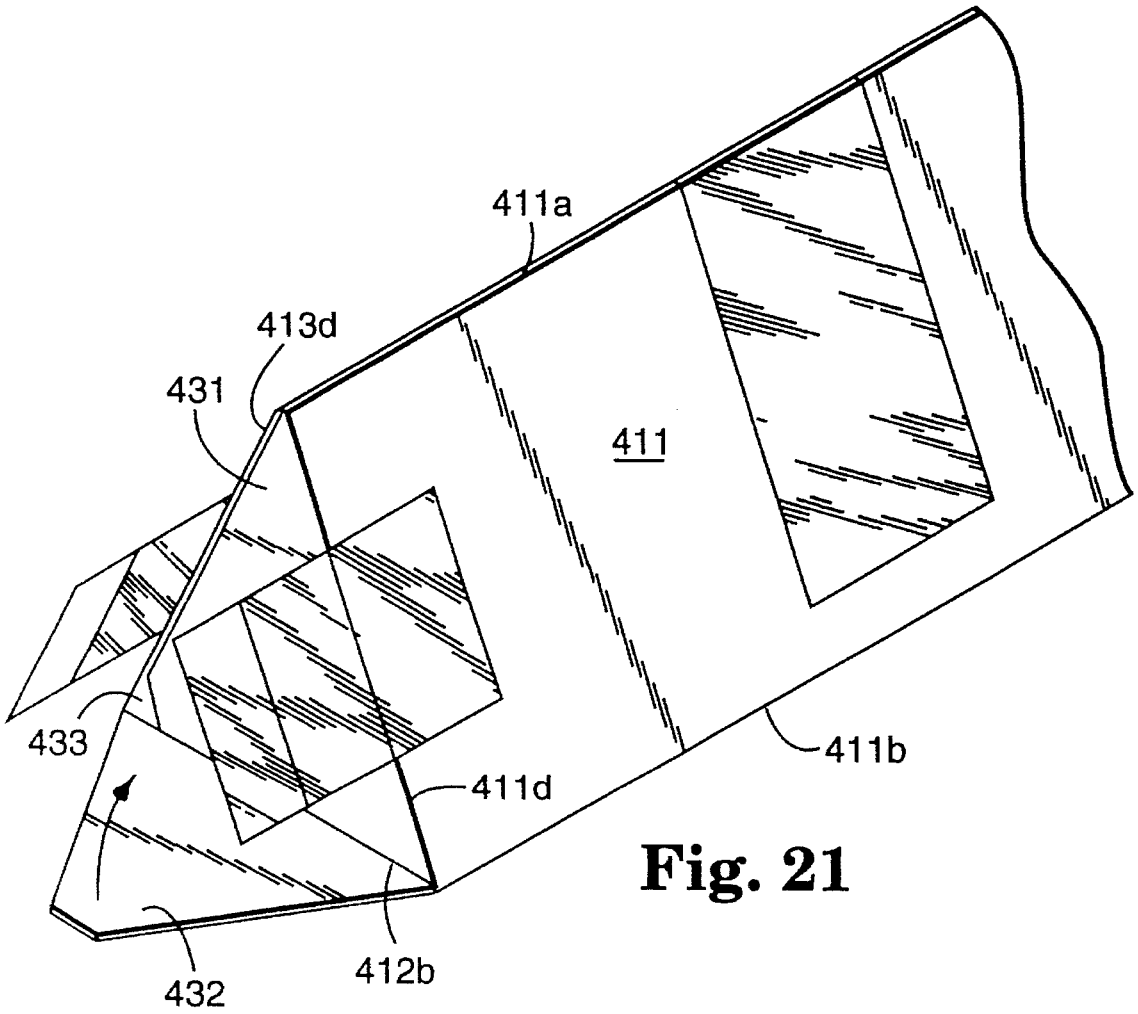

FIG. 21 is a perspective view of the assembled and sealed container blank of FIG. 19.

Figure 22:
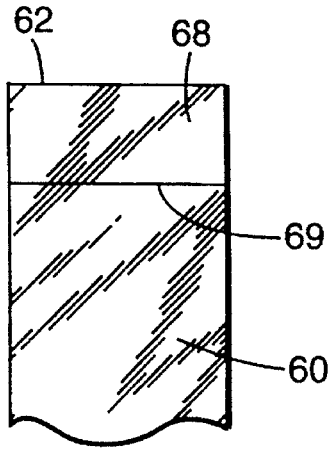

FIG. 22 is a plan view of an alternate tab embodiment of the tape structure of this invention.

DETAILED DESCRIPTION OF THE INVENTION INCLUDING A BEST MODE

Definitions

As used herein, including the claims, the phrase "flap" means any of the components of the container blank, which, when assembled but not yet closed and sealed, are the components still free to move to close the container. As used herein, including the claims, the phrase "panel" means any of the components of the container blank, which, when assembled but prior to closing and sealing the container, are a fixed, stationary component of the container.

As used herein, including the claims, the phrase "assembly opposed flaps" means that the flaps are diametrically opposed to each other after the container is assembled. It is noted that flaps which are not diametrically opposed when the container is in blank form may become diametrically opposed when the container is assembled.

As used herein, including the claims, the phrase "regular slotted container" means a single piece fiber shipping container in which opposing flaps are the same length and the outer flaps meet in the center.

As used herein, including the claims, the phrases "carrier flap," "carrier panel" and "carrier tab" mean the flap, panel or tab of the container blank to which the closure adhesive is mounted prior to assembling and sealing the container blank.

As used herein, the phrases "receiving panel" and "receiving flap" mean the panel or flap of the container blank to which the closure adhesive is adhered when the container blank is assembled and sealed.

| Nomenclature | |
|---|---|
| 10 | Regular Slotted Container Blank |
| 10a | First Open End of Container Blank |
| 10b | Second Open End of Container Blank |
| 11 | First Panel of Container |
| 11a | First Edge of First Panel |
| 11b | Second Edge of First Panel |
| 11c | Score Line Defining First Edge of First Panel |
| 11d | Score Line Defining Second Edge of First Panel |
| 12 | Second Panel of Container |
| 12a | First Edge of Second Panel |
| 12b | Second Edge of Second Panel |
| 12c | Score Line Along First Edge of Second Panel |
| 12d | Score Line Along Second Edge of Second Panel |
| 13 | Third Panel of Container |
| 13a | First Edge of Third Panel |
| 13b | Second Edge of Third Panel |
| 13c | Score Line Along First Edge of Third Panel |
| 13d | Score Line Along Second Edge of Third Panel |
| 14 | Fourth Panel of Container |
| 14a | First Edge of Fourth Panel |
| 14b | Second Edge of Fourth Panel |
| 14c | Score Line Along First Edge of Fourth Panel |
| 14d | Score Line Along Second Edge of Fourth Panel |
| 15 | Score Line Between First and Second Panels |
| 16 | Score Line Between Second and Third Panels |
| 17 | Score Line Between Fourth and First Panels |
| 18 | Attaching Flap |
| 19 | Score Line Between Fourth Panel and Attaching Flap |
| 21a | End Flap Extending from First Edge of First Panel |
| 21b | End Flap Extending from Second Edge of First Panel |
| 21d | Distal Edge of End Flaps On First Panel |
| 22a | Side Flap On First Edge of Second Panel |
| 22b | Side Flap On Second Edge of Second Panel |
| 22d | Distal Edge of Side Flaps On Second Panel |
| 23a | End Flap On First Edge of Third Panel |
| 23b | End Flap On Second Edge of Third Panel |
| 23d | Distal Edge of End Flaps On Third Panel |
| 24a | Side Flap On First Edge of Fourth Panel |
| 24b | Side Flap On Second Edge of Fourth Panel |
| 24d | Distal Edge of Side Flaps On Fourth Panel |
| 50 | Adhesive Tape Structure |
| 60 | Closure Adhesive Tape |
| 60m | Adhesive Layer of Closure Adhesive Tape |
| 60n | Backing Layer of Closure Adhesive Tape |
| 60w | Length of Closure Tape Bonded to Container |
| 60x | Length of Closure Tape Bonded to Target Tape |
| 60y | Length of Closure Tape Bonded to Release Surface |
| 60z | Length of Closure Tape (60w + 60x + 60y) |
| 61 | Fixed End of Closure Tape |
| 62 | Releasable End of Closure Tape |
| 63 | Tab at Releasable End of Closure Tape |
| 65 | Y-shaped Tape Structure |
| 66 | First Length of Tape |
| 67 | Second Length of Tape |
| 67a | First Section of Second Length of Tape |
| 67b | Bonded Mid-Section of Second Length of Tape |
| 67c | Second Section of Second Length of Tape |
| 68 | Detachable Tab |
| 69 | Weakened Line |
| 70 | Target Tape |
| 70m | Adhesive Layer of Target Adhesive Tape |
| 70n | Backing Layer of Target Adhesive Tape |
| 80 | Release Surface |
| 110 | Die-cut Diskette/Book Container Blank |
| 111 | Front Panel |
| 111a | First Edge/Score Line |
| 111b | Second Edge/Score Line |
| 112 | Bottom Panel |
| 112a | First Edge/Score Line |
| 112b | Second Edge/Score Line |
| 112c | Third Edge/Score Line |
| 112d | Fourth Edge/Score Line |
| 113 | Rear Panel |

| Nomenclature | |
|---|---|
| 113a | First Edge/Score Line |
| 113b | Second Edge/Score Line |
| 114 | Top Flap |
| 114a | First Edge |
| 114b | Second Edge |
| 114c | Third Edge/Score Line |
| 114d | Fourth Edge/Score Line |
| 115 | Front Flap |
| 115a | First Edge/Score Line |
| 115b | Second Edge/Score Line |
| 115c | Free Edge |
| 115' | Inner Surface |
| 115" | Outer Surface |
| 116 | Insert Flaps |
| 116a | First Edge |
| 116b | Second Edge |
| 121 | Left Side Panel |
| 122 | Outer Portion |
| 123 | Inner Portion |
| 124 | Double Score Line |
| 125 | Tab |
| 126 | Slot |
| 131 | Right Side Panel |
| 132 | Outer Portion |
| 133 | Inner Portion |
| 134 | Double Score Line |
| 135 | Tab |
| 136 | Slot |
| 140 | Side Interior Panel |
| 141 | Bottom Edge |
| 142 | Side Edge |
| 210 | Die-Cut Tuck In Container Blank |
| 211 | Front Panel |
| 211a | First Edge/Score Line |
| 211b | Second Edge/Score Line |
| 211c | Third Edge/Score Line |
| 211d | Free Edge |
| 212 | Bottom Panel |
| 212a | First Edge |
| 212b | Second Edge |
| 213 | Back Panel |
| 213a | First Edge/Score Line |
| 213b | Second Edge/Score Line |
| 213c | Third Edge/Score Line |
| 213d | Fourth Edge/Score Line |
| 214 | Top Flap |
| 214a | First Edge/Score Line |
| 215 | Tuck Flap |
| 215' | Inner Surface |
| 215" | Outer Surface |
| 215a | Free Edge |
| 221 | Left Side Panel |
| 222 | Bottom Portion |
| 222a | First Edge |
| 223 | Outer Portion |
| 223a | Double Score Line |
| 223b | Bottom Score Line |
| 224 | Inner Portion |
| 225 | Tab |
| 226 | Slot |
| 231 | Right Side Panel |
| 232 | Bottom Portion |
| 232a | First Edge |
| 233 | Outer Portion |
| 233a | Double Score Line |
| 233b | Bottom Score Line |
| 234 | Inner Portion |
| 235 | Tab |
| 236 | Slot |
| 240 | Left Side Interior Panel |
| 240a | Bottom Edge |
| 240b | Side Edge |
| 242 | Right Side Interior Panel |
| 242a | Bottom Edge |
| 242b | Side Edge |
| 310 | Die-Cut Locking Tab Container Blank |
| 310a | First Opening |
| 310b | Second Opening |

| Nomenclature | |
|---|---|
| 311 | First Bottom Panel |
| 311a | First Edge/Score Line |
| 311b | Second Edge/Score Line |
| 311c | Third Edge/Score Line |
| 312 | Back Panel |
| 312a | First Edge/Score Line |
| 312b | Second Edge/Score Line |
| 313 | Top Panel |
| 313a | First Edge/Score Line |
| 313b | Second Edge/Score Line |
| 313c | Third Edge |
| 313d | Fourth Edge |
| 314 | Front Panel |
| 314a | First Edge/Score Line |
| 314b | Second Edge/Score Line |
| 315 | Second Bottom Panel |
| 315a | First Edge/Score Line |
| 321 | First End Flap |
| 321a | Bottom Edge |
| 321b | Top Edge |
| 322 | Second End Flap |
| 322a | Bottom Edge |
| 322b | Top Edge |
| 323 | Third End Flap |
| 323a | Bottom Edge |
| 323b | Top Edge |
| 324 | Fourth End Flap |
| 324a | Bottom Edge |
| 324b | Top Edge |
| 330 | First Closure Flap |
| 330a | First Edge/Score Line |
| 330b | Second Edge |
| 330c | Third Edge |
| 331 | First Tuck Flap |
| 331a | Free Edge |
| 332 | First Slot |
| 340 | Second Closure Flap |
| 340a | First Edge/Score Line |
| 240b | Second Edge |
| 340c | Third Edge |
| 341 | Second Tuck Flap |
| 341a | Free Edge |
| 342 | Second Slot |
| 350 | First Locking Tab |
| 350' | Inner Surface |
| 350" | Outer Surface |
| 350a | First Edge/Score Line |
| 350b | Second Edge |
| 350c | Third Edge |
| 350d | Fourth Edge |
| 351 | Top Portion |
| 352 | Tuck Portion |
| 353 | Score Line |
| 360 | Second Locking Tab |
| 360' | Inner Surface |
| 360" | Outer Surface |
| 360a | First Edge/Score Line |
| 360b | Second Edge |
| 360c | Third Edge |
| 360d | Fourth Edge |
| 361 | Top Portion |
| 362 | Tuck Portion |
| 363 | Score Line |
| 410 | Three Sided Tube Container Blank |
| 410a | First Opening |
| 410b | Second Opening |
| 411 | First Panel |
| 411a | First Edge/Score Line |
| 411b | Second Edge/Score Line |
| 411c | Third Edge/Score Line |
| 411d | Fourth Edge/Score Line |
| 412 | Second Panel |
| 412a | First Edge/Score Line |
| 412b | Second Edge Score Line |
| 413 | Third Panel |
| 413' | Inner Surface |
| 413" | Outer Surface |
| 413a | First Edge/Score Line |

-continued

| Nomenclature | |
|---|---|
| 413b | Second Edge |
| 413c | Third Edge/Score Line |
| 413d | Fourth Edge/Score Line |
| 414 | Inner Panel |
| 414a | First Edge |
| 421 | First Flap |
| 422 | Second Flap |
| 423 | Third Flap |
| 431 | Fourth Flap |
| 432 | Fifth Flap |
| 433 | Sixth Flap |

COMPONENTS

Container Blank

The container blanks described below may be formed from any of the widely accepted materials used to manufacture such containers including corrugated fiberboard, flat fiberboard, corrugated polymeric and cellulosic fibers, sheets of solid polymeric materials, and the like.

REGULAR SLOTTED CONTAINER

Referring to FIG. 1, a regular slotted container (RSC) blank 10 is shown prior to assembly. The RSC blank 10 must include at least one end flap 21/23 and a pair of assembly opposed side flaps 22*a*/24*a* or 22*b*/24*b* positioned at one end 10*a*/10*b* of the container blank 10. The container blank 10 is a unitary piece of material which includes a number of panels 11/12/13/14 and flaps 21*a*/22*a*/23*a*/24*a*/22*b*/22*b*/23*b*/24*b* defined by longitudinally extending 15/16/17 and laterally extending 11*c*/12*c*/13*c*/14*c*/11*d*/12*d*/13*d*/14*d* score lines formed in the container blank 10 in a conventional manner.

The regular slotted container blank 10 includes first, second, third and fourth panels 11/12/13/14 separated from one another by substantially parallel longitudinally extending score lines 15/16/17. An attaching flap 18 extends from the side edge (unnumbered) of the fourth panel 14 and a score line 19 is formed between fourth panel 14 and attaching flap 18 for enabling the flap to be folded at substantially right angles to the fourth panel 14.

Panels 11/12/13/14 include first laterally extending edges 11*a*/12*a*/13*a*/14*a* defined by laterally extending score lines 11*c*/12*c*/13*c*/14*c* and second laterally extending edges 11*b*/12*b*/13*b*/14*b* defined by laterally extending score lines 11*d*/12*d*/12*d*/14*d* respectively. A first set of closure flaps 21*a*/22*a*/22*a*/24*a* are hingedly connected to panels 11/12/13/14 along the first laterally extending edges 11*a*/12*a*/12*a*/14*a* thereof for closing the first open end 10*a* of the container. Similarly, a second set of closure flaps 21*b*/22*b*/23*b*/24*b* are hingedly connected to panels 11/12/13/14 along the second laterally extending edges 11*b*/12*b*/13*b*/14*b* thereof for closing the second end 10*b* of the container. Each of the closure flaps 21*a*/22*a*/23*a*/24*a*/21*b*/22*b*/23*b*/24*b* are separated from one another along the longitudinally extending lateral edges (unnumbered) by slits or slots (unnumbered) so that the closure flaps 21*a*/22*a*/23*a*/24*a*/21*b*/22*b*/23*b*/24*b* may be independently bent along the respective laterally extending score lines 11*c*/12*c*/13*c*/14*c*/11*d*/12*d*/13*d*/14*d* for closing the erected container.

DIE-CUT DISKETTE OR BOOK BOX

Referring to FIG. 10, a die-cut diskette/box container blank 110 is shown prior to assembly. Such containers can be sized to conveniently hold computer diskettes, books, and the like, but are not limited to such uses. The dimensions of the various components of the container blank 110 may be varied to suit the intended contents of the container, without departing from the present invention.

Die-cut container blank 110 includes front panel 111, bottom panel 112, and rear panel 113. Front and bottom panels 111 and 112 are hingedly connected at third edge or score line 112*c*, and the bottom and rear panels 112 and 113 are hingedly connected at forth edge or score line 112*d*. Die cut container blank 110 further includes left side panel 121 hingedly connected to bottom panel 112 at first edge or score line 112*a*, and right side panel 131 is hingedly connected to bottom panel 112 at second edge or score line 122*b*. Left side panel 121 is divided into outer portion 122 and inner portion 123 by double score line 124. Similarly, right side panel 131 is divided into outer portion 132 and inner portion 133 by double score line 134. On the outermost edge of left side panel 121 is tab 125, and on the outermost edge of right side panel 131 is tab 135.

A first side interior panel 140 is hingedly connected to one side of front panel 111 at score line 111*a*, and a second side interior panel 140 is hingedly connected opposite the first at score line 111*b*. Similarly, a third side interior panel 140 is hingedly connected to one side of rear panel 113 at score line 113*a*, and a fourth side interior panel 140 is hingedly connected opposite the third at score line 113*b*. Each of the interior side panels 140 has a bottom edge 141 and side edge 142. A first slot 126 is formed in bottom panel 112 along score line 112*a* to receive tab 125, and a second slot 136 is formed along score line 112*b* to receive tab 135.

Top flap 114 is hingedly attached to rear panel 113 along third edge or score line 114*c*. Top flap 114 is configured to fold over the opening bounded by the front, rear and side panels 112, 113, 121 and 131 of the container when container blank 110 is assembled, with top flap 114 being opposite to and parallel with bottom panel 112. Front flap 115 is hingedly connected to top flap 114 along forth edge or score line 114*d*. Front flap 115 has free edge 115*c* opposite score line 114*d*. Hingedly connected to one side of front flap at first edge or score line 115*a* is first insert flap 116. Second insert flap 116 is hingedly connected to front panel 115 at the opposite edge or score line 115*b*. Insert flaps 116 each have a first edge 116*a* and arcuate second edge 116*b*. Front flap 115 is configured to overlap front panel 111 when the container blank 110 is fully assembled and closed, with insert flaps 116 tucked into slots formed by the left and right side panels 121 and 131. Front flap has inner surface 115' which will be adjacent front panel 111 when assembled, and outer surface 115" opposite the inner surface.

DIE-CUT TUCK IN BOX

Referring to FIG. 13, a die-cut tuck in container blank 210 is shown prior to assembly. Die-cut container blank 210 includes front panel 211, bottom panel 212, and rear panel 213. Front and bottom panels 211 and 212 are hingedly connected at first edge or score line 211*a*, and the bottom and rear panels 212 and 213 are hingedly connected at edge or score line 213*a*. Tuck in container blank 210 further includes a left side panel 221 hingedly connected to bottom panel 212 at edge or score line 213*c*, and right side panel 231 hingedly connected to bottom panel 212 at edge or score line 213*d*.

Left side panel 221 is divided into three portions: bottom portion 222, outer portion 223, and inner portion 224. Bottom portion 222 and outer portion 223 are hingedly connected at score line 223*b*, and outer portion 223 is hingedly connected to inner portion 224 by double score line 223*a*. On the opposite edge of inner portion 224 is tab 225 sized to lock into slot 226 formed in bottom portion 222 along score line 223*b*. Likewise, right side panel 231 is divided into three portions: bottom portion 232, outer portion 233, and inner portion 234. Bottom portion 232 and outer portion 233 are hingedly connected at score line 233*b*, and outer portion 233 is hingedly connected to inner portion 234 by double score line 233*a*. On the opposite edge of inner portion 234 is tab 235 sized to lock into slot 236 formed in bottom portion 232 along score line 233*b*.

A left side interior panel 240 is hingedly connected to one side of front panel 211 at score line 211*b*, and a right side interior panel 242 is hingedly connected opposite the first at score line 211*c*. Left side interior panel 240 has a bottom edge 240*a* and side edge 240*b*. Right side interior panel 242 likewise has a bottom edge 242*a* and side edge 242*b*.

Top flap 214 is hingedly attached to rear panel 213 along edge or score line 213*b*. Top flap 114 is configured to fold over the opening bounded by the front, rear and side panels 211, 213, 221 and 231 of the container when container blank 210 is assembled, with top flap 214 being opposite to and parallel with bottom panel 212. Tuck flap 215 is hingedly connected to top flap 214 along edge or score line 114*d*. Front flap 115 has free edge 115*c* opposite score line 214*a*. Tuck flap 215 is configured to tuck inside the closed container and lay adjacent to front panel 211 when the container blank 210 is fully assembled and closed. Tuck flap 215 has outer surface 215" which will be adjacent front panel 211 when assembled, and inner surface 215' opposite the inner surface.

DIE-CUT LOCKING TAB BOX

Referring to FIG. 16, a die-cut locking tab container blank 310 is shown. Container blank 310 includes a first bottom panel 311 hingedly connected at first edge/score line 311*a* to back panel 312. Opposite score line 311*a*, back panel 312 is hingedly connected at edge/score line 313*a* to top panel 313. Opposite edge/score line 313*a*, top panel 313 is hingedly connected at edge/score line 313*b* to front panel 314. Opposite edge/score line 313*b*, front panel 314 is hingedly connected at edge/score line 315*a* to top panel 315. These five panels are configured such that the container blank 310 may be folded into a container wherein second bottom panel 315 overlaps and remains adjacent to first bottom panel 311, with top panel 313 opposed to and parallel to second bottom panel Back panel 312 and front panel 314 will now be parallel to and facing one another across the top and bottom panels. This will form an open container having first opening 310*a* at one side and second opening 310*b* opposite the first opening.

Hingedly connected to back panel 312 at edge/score line 312*a* is first end flap 321, and hingedly connected on the opposite edge/score line 312*b* of back panel 312 is third end flap 323. First and third end flaps each have a bottom edge 321*a*, 323*a*, respectively, facing first bottom panel 311, and top edges 321*b*, 323*b*, respectively, facing top panel 313. Likewise, second end flap 322 is hingedly connected to front panel 314 at edge/score line 314*a*, and hingedly connected to front panel 314 on opposite edge/score line 314*b* is fourth end flap 324. Second and fourth flaps each have a bottom edge, 322*a*, 322*b*, respectively, facing second bottom panel 315, and top edge 322*b*, 324*b*, respectively, facing top panel 313.

First closure flap 330 is hingedly connected to first bottom panel 311 at score line 311*b*, on the side of container blank 310 which forms the first opening 310*a*. On the opposite side of first closure flap 330, first tuck flap 331 is hingedly connected along edge/score line 330*a*. First tuck flap 330 has formed therein first slot 332 along score line 330*a*. Likewise, second closure flap 340 is hingedly connected to first bottom panel 311 at score line 311*c*, on the side of container blank 310 which forms the second opening 310*b*. On the opposite side of second closure flap 340, second tuck flap 341 is hingedly connected along edge/score line 340*a*. Second tuck flap 340 has formed therein second slot 342 along score line 340*a*.

First and second locking tabs 350, 360 are hingedly connected to top panel 313 at the sides of the top panel forming the first and second container openings, 320*a*, 320*b*, respectively. First locking tab 350 is hingedly connected to top panel 313 at edge/score line 350*a*. First locking tab 350 has inner surface 350' and outer surface 350". Score line 353 divides locking tab 350 into top portion 351 adjacent top panel 313 and locking portion 352 extending beyond top panel 313. Locking portion 352 has free edge 350*d* opposite score line 353. Top portion 351 is separated form top panel 313 by opposite free edges 350*b* and 350*c*. Likewise, second locking tab 360 is hingedly connected to top panel 313 at edge/score line 360*a*. Second locking tab has inner surface 360' and outer surface 360". Score line 363 divides locking tab 360 into top portion 361 adjacent top panel 313 and locking portion 362 extending beyond top panel 313. Locking portion 362 has free edge 360*d* opposite score line 363. Top portion 361 is separated form top panel 313 by opposite free edges 360*b* and 360*c*.

THREE SIDED TUBE BOX

Referring to FIG. 19, a three sided tube container blank 410 is shown. Container blank 410 includes an inner panel 414 hingedly connected at first edge/score line 411*a* to first panel 411. Opposite score line 411*a*, first panel 411 is hingedly connected at edge/score line 411*b* to second panel 412. Opposite edge/score line 411*b*, second panel 412 is hingedly connected at edge/score line 413*b* to third panel 413. These four panels are configured such that the container blank 410 may be folded into a container wherein inner panel 414 overlaps and remains adjacent to third panel 413, thereby forming a triangular container having first panel 411 as its first side, second panel 412 as its second side and overlapping panels 413 and 414 as the third side. This will form an open container having first opening 410*a* at one side and second opening 40*b* opposite the first opening.

Three closure panels 421, 422, 423 are hingedly connected at the edges of the first, second and third panels 411, 412, 413 which form the first opening 410*a*. First closure flap 421 is hingedly connected at score line 411*c* to first panel 411, second closure flap 421 is hingedly connected at score line 412*a* to second panel 412, and third closure flap 423 is hingedly connected at score line 413*c* to third panel 413. Three additional closure panels 431, 432, 433 are hingedly connected at the edges of the first, second and third panels 411, 412, 413 which form the second opening 410*b*. Fourth closure flap 431 is hingedly connected at score line 411*d* to first panel 411, fifth closure flap 431 is hingedly connected at score line 412*b* to second panel 412, and sixth closure flap 433 is hingedly connected at score line 413*d* to third panel 413. All of the closure flaps are generally triangular, having a truncated corner opposite the score lines attaching the flaps to the panels. The flaps are configured to overlap one another thereby closing the first and second openings of the assembled container blank 410.

Adhesive Tape Structure

CLOSURE ADHESIVE TAPE

The adhesive tape structure 50 will first be described with respect to RSC blank 10. Each of the embodiments of the adhesive tape structure 50 and its components may also be employed with other container blank configurations, including those described herein.

The adhesive tape structure 50 includes a length of closure adhesive tape 60 which may be peeled from the side flap 21*a*/21*b*/23*a*/23*b* of the container blank 10 without losing complete contact with the container blank 10 and adhesively bonded along the distal edges 22*d*/24*d* of a pair of opposed side flaps 22*a*/24*a* or 22*b*/24*b*. The reapplied closure tape 60 covers the seam (not shown) between the flaps 22*a*/24*a* or 22*b*/24*b* and bonds the pair of side flaps 22*a*/24*a* or together so as to close an open end of the container. In the RSC blank embodiment, side flaps 21*a*/21*b*/23*a*/23*b* are carrier flaps and side flaps 22*a*/22*b*/24*a*/24*b* are receiving flaps.

Two lengths of tape structure 50 are positioned at each open end 10*a*/10*b* of the RSC container blank The tape structure 50 must extend over a portion of the first 11 and third 13 panels and across the respective end flaps 21*a*/21*b*/23*a*/23*b* to at least proximate the distal edges 21*d*/23*d* of the end flaps 21*a*/21*b*/23*a*/23*b*. The tape structure 50 must be positioned relative to the second 12 and fourth 14 panels so that they are positioned directly underneath the seam (not shown) formed by each set of paired side flaps 22*a*/24*a* or 22*b*/24*b* when that open end 10*a*/10*b* of the container is closed. The lengths of tape structure 50 must be laminated to a release surface 80 at least along the surface of the end flaps 21*a*/21*b*/23*a*/23*b* so that the tape structure 50 may be peeled from the end flap 21*a*/21*b*/23*a*/23*b* and applied across the seam (not shown) of the corresponding pair of side flaps 22*a*/24*a* or 22*b*/24*b* during assembly.

Figure 2:
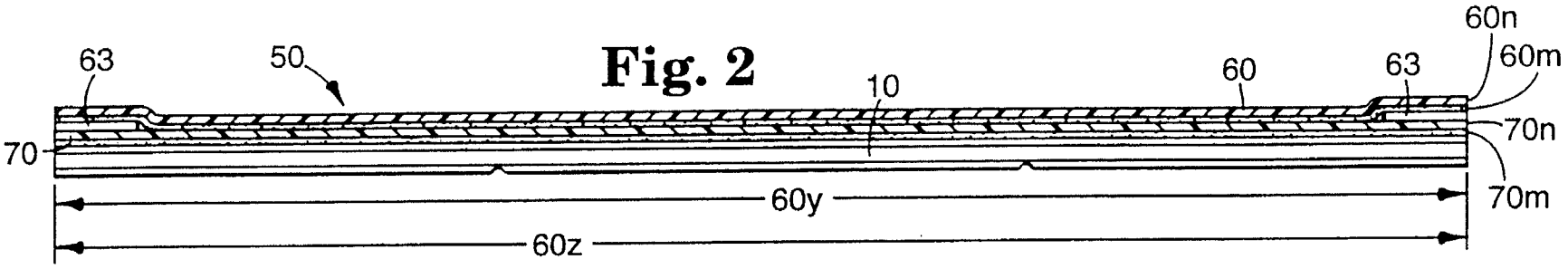
FIG. 2 is a cross-sectional view of the pretaped container blank of FIG. 1 taken along line 2—2 showing the layers of container, target tape adhesive, target tape backing, closure tape adhesive and closure tape backing.

Various configurations of tape structures 50 may be employed to achieve the necessary functionality described above. A first configuration is shown in FIGS. 1 and 2 where the release surface 80 and closure adhesive tape 60 extend completely across the entire length of the container blank 10 from the distal edge 21*d*/23*d* at one open end 10*a* to the distal edge 21*d*/23*d* at the other 10*b*. Release surface 80 in this embodiment is the release treated back surface of a second length of adhesive tape.

As shown in FIG. 1, this configuration does not include a length 60*w* of the closure adhesive tape 60 bonded to the container blank 10. The entire length 60*z* of closure tape 60 is laminated to the release surface 80.

This configuration is simple to manufacture but includes unnecessary lengths of closure tape 60 and release surface 80 along the center of the panels 11/13. In addition, the closure tape 60 is not permanently bonded to the container blank 10 anywhere along the length of the closure tape 60 such that a user unfamiliar with the procedure for assembling the container blank 10 may mistakenly or accidentally remove the entire length of closure tape 60 from the container blank 10.

Figure 3:
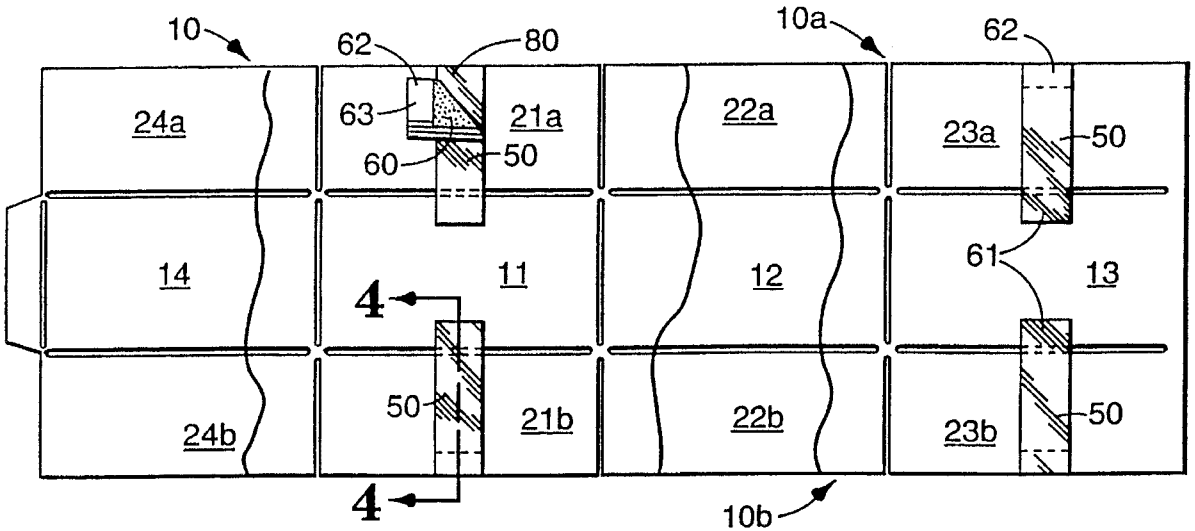
FIG. 3 is a plan view of the regular slotted container embodiment of a pretaped container blank of this invention including a second embodiment of a tape structure.
Figure 4:
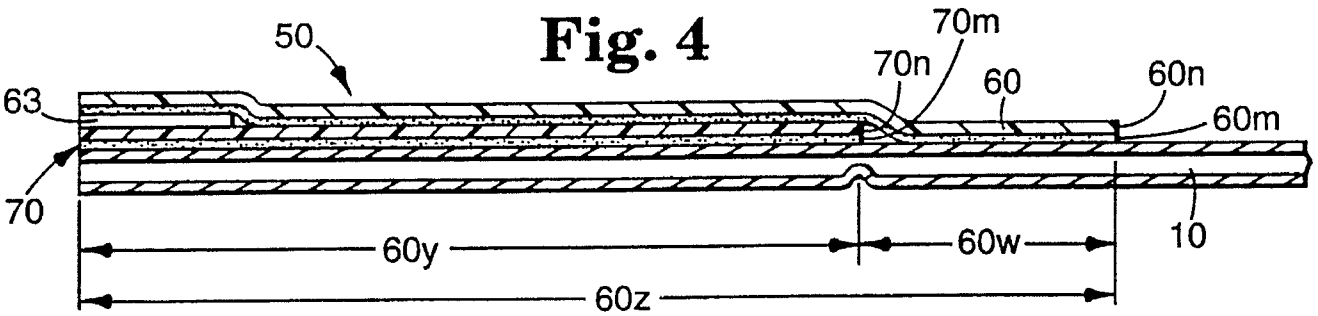
FIG. 4 is a cross-sectional view of the pretaped container blank of FIG. 3 taken along line 4—4 showing the layers of container, low adhesion backsize, closure tape adhesive and closure tape backing.

A second configuration is shown in FIGS. 3 and 4 where the release surface 80 extends only across the end flap 21*a*/21*b*/23*a*/23*b* and the closure adhesive tape 60 extends across both a portion of the panel 11/13 and the corresponding end flap 21*a*/21*b*/23*a*/23*b*. This configuration provides that each tape structure 50 includes a detachable length 60*y* of closure adhesive tape 60 laminated to a release surface 80 across the end flaps 21*a*/21*b*/23*a*/23*b* for closing the open end 10*a*/10*b* of the container blank 10 and a length 60*w* of closure adhesive tape 60 permanently bonded to the panel 11/13 of the container 10 for preventing complete removal of the closure tape 60 from the container blank 10 during assembly and securing the closure tape 60 and side flaps 22*a*/22*b*/24*a*/24*b* in position after assembly.

Figure 2A:
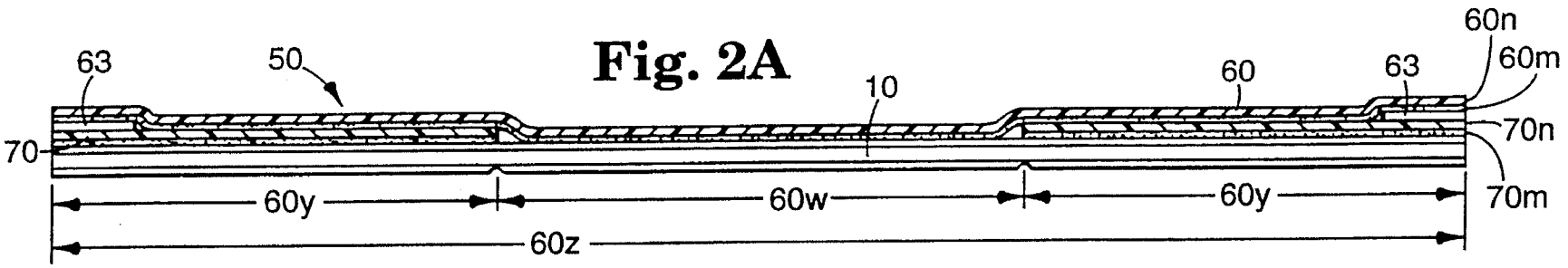
FIG. 2A is a view like FIG. 2 showing an alternative embodiment of the tape structure.

Alternatively, as shown in FIG. 2A, the second configuration may include a single length of closure tape 60 which extends across both end flaps 21*a*/21*b* or 23*a*/23*b* and the panel 11/13 to which the end flaps 21*a*/21*b* or 23*a*/23*b* are connected. Such an alternate embodiment simplifies construction of the container blank 10 by forming two tape structures 50 with a single length of closure tape 60.

While generally acceptable, the second configuration is not completely foolproof. Conceivably, a user unfamiliar with the procedure for assembling the container blank 10 may mistakenly peel the closure tape 60 not only from the end flaps 21*a*/21*b*/23*a*/23*b* as appropriate but also from the panel 11/13 of the container blank 10 even though removal from the panel 11/13 is much more difficult and will tend to rip the container blank 10.

One option for preventing complete removal of the closure tape 60 from the RSC container 10 is to use a target tape 70 as the release surface 80, forming a longitudinally extending laterally overhanging length of closure tape 60 by either employing a closure tape 60 which is wider than the target tape 70 or laterally offsetting the closure tape 60 relative to the target tape 70, and then—along at least a portion of the tape structure 50 connected to the panel 11/12/13—folding or tucking the overhanging longitudinal edge of the closure tape 60 under the target tape 70 to form an adhesive-to-adhesive bond between the tapes 60/70 as shown in FIGS. 9*b* and 9*c*. Formation of such a longitudinally hemmed adhesive tape structure is disclosed in U.S. Pat. No. 5,079,900 issued to Pinckney et al. and assigned to the Minnesota Mining and Manufacturing Company, which is incorporated herein by reference.

Figure 5:
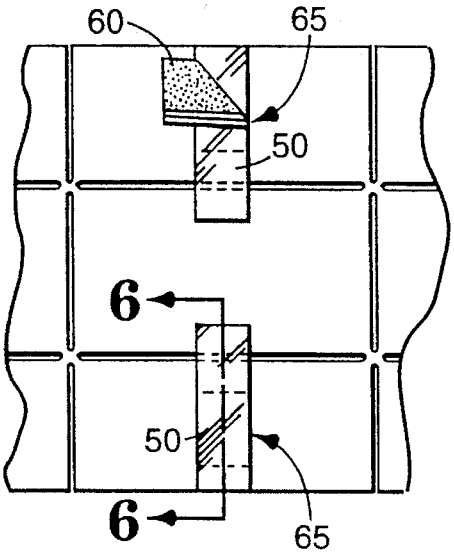
FIG. 5 is a plan view of the regular slotted container embodiment of a pretaped container blank of this invention including a third embodiment of a tape structure.
Figure 6:
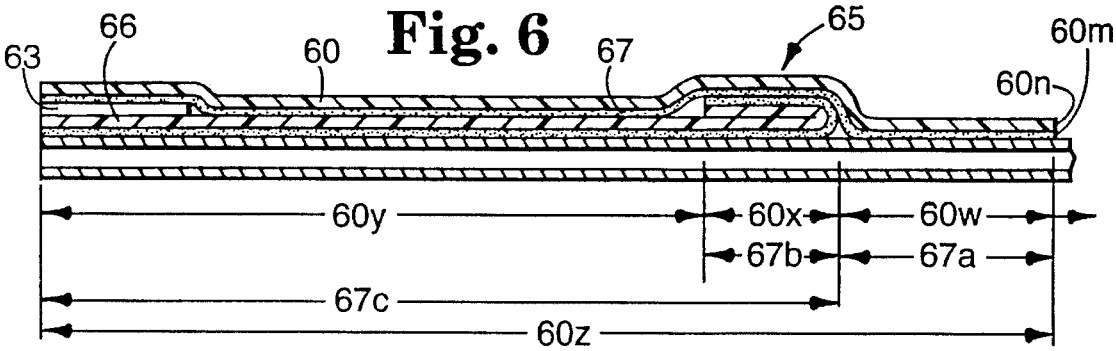
FIG. 6 is a cross-sectional view of the pretaped container blank of FIG. 5 taken along line 6—6 showing the various layers of container, adhesive and backing.
Figure 8:
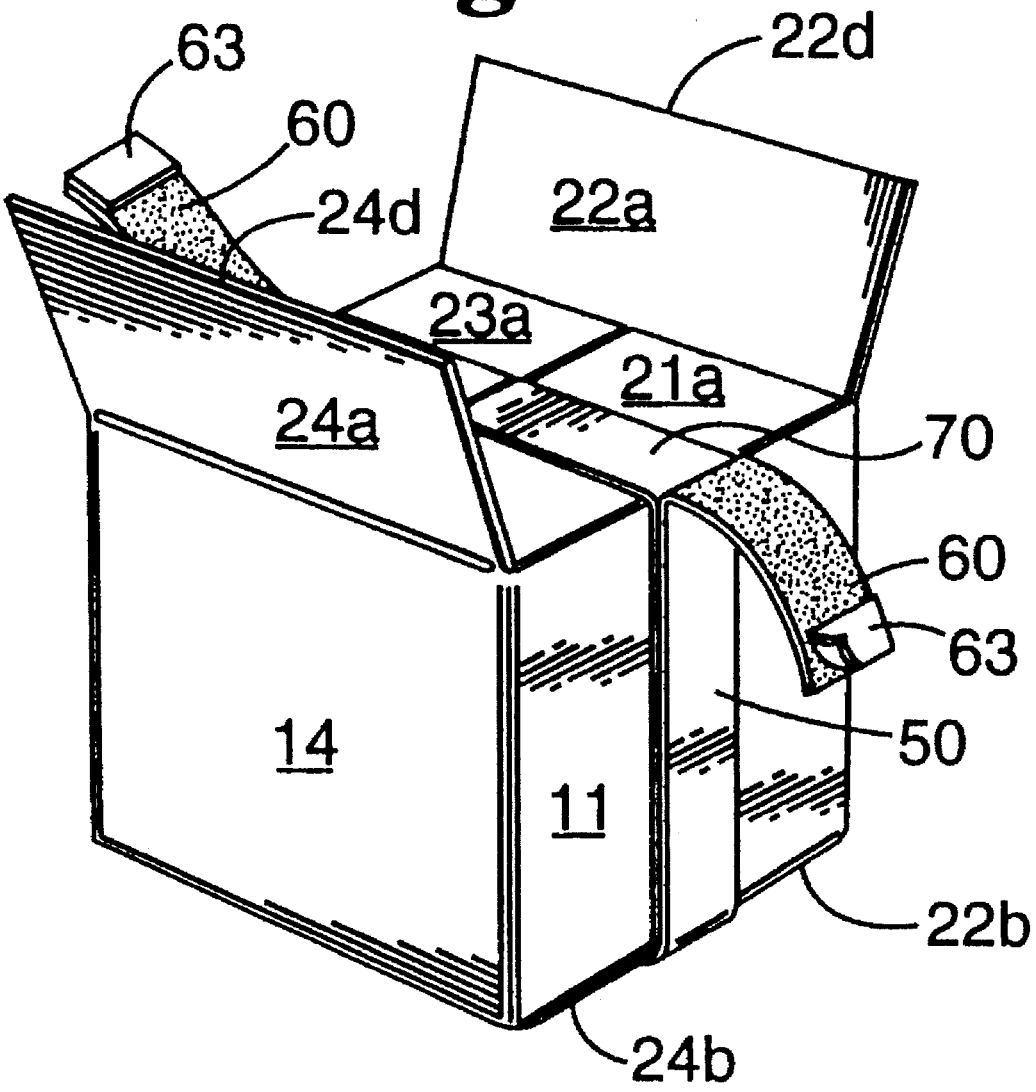
FIG. 8 is a partially assembled perspective view of the pretaped container blank of FIG. 1.

A nearly foolproof configuration is shown in FIGS. 5 and 6. A Y-shaped tape structure 65 is formed by contacting the end of a first length of tape 66 to the mid-section of a second length of tape 67 with the adhesive coated surfaces of both lengths bonded together for a short distance 60*x*. The first length of tape 66 (one of the legs of the Y structure) divides the second length of tape 67 into a first adhesive section 67*a* (the other leg of the Y structure), a bonded mid-section 67*b* where the first 66 and second 67 lengths of closure tape 60 are joined, and a second adhesive section 67*c* which—along with the bonded mid-section 67*b*—forms the base of the Y structure.

The Y-shaped tape structure 65 is applied to the RSC container blank 10 by (i) positioning the crotch of the Y-shaped tape structure 65 proximate to the score line 11*c*/11*d*/13*c*/13*d* between the panel 11/13 and corresponding end flap 21*a*/21*b*/23*a*/23*b* to which the tape structure 65 is to be attached with the crotch parallel to the score line 11*c*/11*d*/13*c*/13*d* and resting either directly on the score line 11*c*/11*d*/13*c*/13*d* or the panel 11/13 but not the end flap 21*a*/21*b*/23*a*/23*b*, (ii) adhesively bonding the first length of tape 66 (one of the legs of the Y) to the end flap 21*a*/21*b*/23*a*/23*b*, (iii) adhesively bonding the first adhesive section 67*a* of the second length of tape (the other leg of the Y) to the corresponding panel 11/13, and (iv) aligning the bonded mid-section 67*b* and second adhesive 67*c* sections of the second length of tape 67 (the base of the Y) with the previously applied first length of tape 66. The first length of tape 66 functions as a release surface 80 for the second adhesive section 67*c* of the second length of tape 67. The legs of the Y-shaped tape structure 65—which are adhesively bonded to the container blank 10 in opposite directions—prevent the tape structure 65 from being peeled from the container blank 10 by pulling on the second adhesive section 67*c* of the second length of tape 67.

When the side flaps 22*a*/22*b*/24*a*/24*b* of the container blank 10 are wider than the length of the end flaps 21*a*/21*b*/23*a*/23*b* the tape structure 50 may be extended over the distal edge 21*d*/23*d* of the end flap 21*a*/21*b*/23*a*/23*b* and onto the back surface (unnumbered) of the end flap 21*a*/21*b*/23*a*/23*b* in order to provide a length of closure adhesive tape 60 long enough to extend across substantially the entire seam (not shown) between the side flaps 22*a*/24*a* or 22*b*/24*b*. The back surface (unnumbered) of the end flaps 21*a*/21*b*/23*a*/23*b* is treated with a release coating to allow the closure tape 60 to be peeled from the end flap 21*a*/21*b*/23*a*/23*b* for use in assembling the container 10.

With respect to the die-cut diskette/book container blank 110, tape structure 50 is arranged as follows. The front flap 115 is the carrier flap and bottom panel 112 is the receiving panel. The invention will be described with respect to a single tape structure 50, however it is understood that additional tape structures may be placed side by side or spaced along front flap 115. As seen in FIGS. 10–12, tape structure 50 is mounted to front flap 115 such that adhesive closure tape 60 can be peeled back from the front flap and adhered to the bottom panel 112 to seal the container closed. Release surface 80 is located on inner surface 115' of front flap 115, extending from free edge 115*c* of the front flap towards score line 114*d* where the front flap and top flap 114 are hingedly connected. Release surface 80 should be long enough to releasably secure the length 60*y* of adhesive closure tape 60 which is necessary to adequately seal front flap 115 to bottom panel 112. That is, when the container blank 110 is assembled and closed, the length 60*y* of closure adhesive tape which was releasably secured to the inner surface 115' of front flap 115 will now be securely adhered to bottom panel 112 beginning at score line 112*c* which joins the front panel 111 to the bottom panel 112. The closure tape will extend for a distance 60*y* onto the bottom panel 112 as seen in FIG. 12.

Tape structure 50 can be of any of the embodiments described above with respect to RSC blank 10. As seen in FIG. 11, closure adhesive tape 60 must extend from free edge 115*c* of front flap 115 along the outer surface 115" of the flap for a distance sufficient to prevent complete removal of tape 60 from container blank 10 when it is peeled back from release surface 80 on the inner panel surface 115', and may, if desired, extend beyond score line 114*d* onto top flap 114. Release surface 80 may be target tape 70 adhered to inner surface 115' of front panel 115. Target tape 70 may extend around free edge 115*c* onto outer surface 115" for the full length of closure tape 60, similar to the arrangement shown in FIG. 2 with respect to the RSC container blank 10. However, such an arrangement is prone to having the closure tape 60 completely removed from the container blank 110 during assembly, as discussed above. One way to minimize this risk would be to employ a closure tape 60 which is wider than the target tape 70 or laterally offsetting the closure tape 60 relative to target tape 70 and then folding or tucking the overhanging longitudinal edge of the closure tape 60 under the target tape 70 to form an adhesive-to-adhesive bond between the tapes 60 and 70 as seen in FIGS. 9*b* or 9*c*. The overlapping portion could be at free edge 115*c* or on outer surface 115" of front flap 115.

Advantageously, release surface 80 will be limited to the inner surface 115', such that a length 60*w* of closure tape 60 will be directly adhered to the container blank 110 for a sufficient distance on outer surface 115" to prevent the tape 60 from accidently being completely removed, and may, if desired, extend beyond score line 114*d* onto top flap 114. This arrangement would be similar to that shown in FIG. 4 with respect to RSC container blank 10.

Another arrangement to minimize the risk of complete removal of adhesive closure tape 60 is that shown in FIGS. 5 and 6 with respect to RSC container 10 described above. As applied to container blank the crotch of the Y structure 65 would be placed at the free edge 115*c*, or near the free edge on outer surface 115" of the front flap 115. The first length of tape 66, one of the legs of the Y, would be adhered to the inner surface 115' if the crotch of the Y is placed on free edge 115*c*. First length 66 would extend onto outer surface 115" if the crotch of the Y is placed some distance away from free edge 115*c* on outer surface 115". The second length of tape 67, the other leg of the Y, would be adhered to outer surface 115" and may possibly extend onto top flap 114. The bonded midsection 67*b* and second adhesive section 67*c* would be overlapped with the first length 66, which would thus act as release surface 80. Second adhesive section 67*c* can be peeled from the release surface 80 on inner surface 115' and then adhered to bottom panel 112 to seal assembled container blank 110.

With respect to the die-cut tuck in container blank 210, tape structure 50 is arranged as follows. The tuck flap 215 is the carrier flap and front panel 211 is the receiving panel. The invention will be described with respect to a single tape structure 50 as illustrated in FIGS. 13–16, however it is understood that addition tape structures may be placed side by side or spaced along tuck flap 215. Tape structure 50 is mounted to tuck flap 215 such that adhesive closure tape 60 can be peeled back from the tuck flap and adhered to the front panel 211 to seal the container closed. Release surface 80 is located on outer surface 215" of tuck flap 215, extending from score line 214*a*, where the tuck flap and top flap 214 are hingedly connected, towards free edge 215*a* of the tuck flap. Release surface 80 should be long enough to releasably secure the length 60*y* of adhesive closure tape 60 which is necessary to adequately seal top flap 214 to front panel 211. That is, when the container blank 210 is assembled and closed as shown in FIG. 15, the length 60*y* of closure adhesive tape which was releasably secured to the outer surface 115" of tuck flap 215 will now be securely adhered to front panel 211 beginning at free edge 211*d* of front panel 211 and continuing towards score line 211*a* which joins the front panel 211 to the bottom panel 212. The closure tape can optionally be long enough to extend for a desired distance onto bottom panel 212. For such an arrangement, release surface 80 will continue beyond outer surface 215" of the tuck flap, around free edge 215*a* of the tuck flap and onto inner surface 215'. The portion 60*y* of the closure tape releasably adhered to release surface 80 will likewise extend onto inner surface 215'.

Tape structure 50 applied to container blank 210 can be of any of the embodiments described above with respect to the other container blanks. As shown in FIG. 13, closure adhesive tape 60 must extend from score line 214*a* of tuck flap 215 along the outer surface of the top flap 214 for a distance sufficient to prevent complete removal of tape 60 from container blank 210 when it is peeled back from release surface 80 on the outer panel surface 215". Release surface 80 may be target tape 70 adhered to outer surface 215" of front panel 215. Target tape 70 may extend beyond score line 214*a* onto the outer surface of the top flap 214 for the full length of closure tape 60, similar to the arrangement shown in FIG. 2 with respect to the RSC container blank 10. However, such an arrangement is prone to having the closure tape 60 completely removed from the container blank 210 during assembly, as discussed above. One way to minimize this risk would be to employ a closure tape 60 which is wider than the target tape 70 or laterally offsetting the closure tape 60 relative to target tape 70 and then folding or tucking the overhanging longitudinal edge of the closure tape 60 under the target tape 70 to form an adhesive-to-adhesive bond between the tapes 60 and 70 as seen in FIGS. 9*b* or 9*c*. The overlapping portion could be at score line 214*a* or on the outer surface of top flap 214.

Advantageously, release surface 80 will not extend beyond score line 214*a*, such that a length 60*w* of closure tape 60 will be directly adhered to the container blank 210 for a sufficient distance on the outer surface of top flap 214 to prevent the tape 60 from accidently being completely removed. This arrangement would be similar to that shown in FIG. 4 with respect to RSC container blank 10.

Another arrangement to minimize the risk of complete removal of adhesive closure tape 60 is the Y arrangement shown in FIGS. 5 and 6 with respect to RSC container 10 described above. As applied to container blank 210, the crotch of the Y structure 65 would be placed at the score line 214*a* between the tuck flap 215 and the top flap 214, or near the score line on the outer surface of top flap 214. The first length of tape 66, one of the legs of the Y, would be adhered to the outer surface 215" if the crotch of the Y is placed on score line 214*a*. First length 66 would extend onto the outer surface of top flap 214 if the crotch of the Y is placed away from score line 214*a* some distance on top flap 214. The second length of tape 67, the other leg of the Y, would be adhered to top flap 214. The bonded mid-section 67*b* and second adhesive section 67*c* would be overlapped with the first length 66, which would thus act as release surface 80. Second adhesive section 67*c* can be peeled from the release surface 80 on outer surface 215" and then adhered to front panel 211 to seal assembled container blank 210. If it is desired that an additional length of closure tape 60 extend onto bottom panel 212 to more securely seal the container, then first length 66 of the Y structure will continue around free edge 215*a* of tuck flap 215 and onto inner surface 215', providing a longer release surface 80 which would allow for a longer portion 67*c* of the adhesive closure tape 60 to be releasably secured to release surface 80.

With respect to the die-cut locking tab container blank 310 illustrated in FIGS. 16–18, tape structure 50 is arranged as follows. The first and second locking tabs 350, 360 are the carrier tabs, and first and second closure flaps 330, 340 are the receiving flaps. Tape structure 50 is mounted to each locking tab such that adhesive closure tape 60 can be peeled back from the outer surface 350", 360" of each locking tab and adhered to the first and second closure flaps 330, 340 to seal the container closed after the tuck portion 352, 362 of each locking tab is inserted into the slots 332, 342, respectively, of the closure flaps. Release surface 80 is located on outer surface 350", 360" of each locking tab, extending at least from score lines 353, 363, where the top and tuck portions of each locking tab are connected, towards free edges 350*d*, 360*d* of each locking tab. Release surface 80 should be long enough to releasably secure the length 60*y* of adhesive closure tape 60 which is necessary to adequately seal closure flaps 330 and 340 to the top portions 351, 361 of each locking tab. That is, when the container blank 310 is assembled and closed as shown in FIG. 18, the length 60*y* of closure adhesive tape which was releasably secured to each outer surface 350", 360" of the locking tabs will now be securely adhered to the closure flaps beginning at score lines 330*a*, 340*a* of the closure flaps 330, 340 and continuing towards score lines 311*b*, 311*c* which join the closure flaps to the first bottom panel 311. The closure tape can optionally be long enough to extend for a desired distance onto first bottom panel 311. For such an arrangement, release surface 80 will continue beyond the outer surfaces 350", 360" of the locking tabs, around each free edges 350*d*, 360*d* of the locking tabs and onto inner surfaces 350', 360' of the locking tabs The portion 60*y* of the closure tape releasably adhered to release surface 80 will likewise extend onto inner surfaces 350', 360'.

Tape structure 50 applied to container blank 310 can be of any of the embodiments described above with respect to the other container blanks. As seen in FIG. 16, closure adhesive tape 60 must extend from score lines 353, 363 of locking tabs 350, 360 onto the top portions 351, 361 of the locking tabs for a distance sufficient to prevent complete removal of tape 60 from container blank 310 when it is peeled back from release surface 80 on the outer locking tab surfaces 350", 360". Release surface 80 may be target tape 70 adhered to the outer surfaces 350", 360" of the locking tabs. Target tape 70 may be two individual lengths of tape, one per tab, or may alternatively extend as a single length of tape from beyond score line 353 of the first locking tab to beyond score line 363 of the second locking tab, as would of closure tape 60, similar to the arrangement shown in FIG. 2 with respect to the RSC container blank 10. However, such an arrangement is prone to having the closure tape 60 completely removed from the container blank 310 during assembly, as discussed above. One way to minimize this risk would be to employ a closure tape 60 which is wider than the target tape 70 or laterally offsetting the closure tape 60 relative to target tape 70 and then folding or tucking the overhanging longitudinal edge of the closure tape 60 under the target tape 70 to form an adhesive-to-adhesive bond between the tapes 60 and 70 as seen in FIGS. 9*b* or 9*c*. The overlapping portion could be at the score lines 353, 363, on the top portions 351, 361, or on the outer surface of top panel 313.

Advantageously, release surface 80 will not extend beyond score lines 353, 363 and onto top portions 351, 361 of the locking tabs. With such an arrangement, a length 60*w* of closure tape 60 will be directly adhered to the container blank 310 for a sufficient distance on the outer surface of the locking tab top portions 351, 361, and may extend onto top panel 313, to prevent the tape 60 from accidently being completely removed. Two separate lengths of closure tape 60 could be used, or a single length extending from the release surface on the first locking tab, continuing across and securely adhered to the top panel 313, and ending on the release surface on the second locking tab. This arrangement would be similar to that shown in FIG. 4 with respect to RSC container blank 10.

Another arrangement to minimize the risk of complete removal of adhesive closure tape 60 is the Y arrangement shown in FIGS. 5 and 6 with respect to RSC container 10 described above as applied to die-cut locking tab container blank 310. One Y structure would be applied to each locking tab of container blank 310. The crotch of each Y structure 65 would be placed at the score lines 353, 363 between the tuck portions 352, 362 and the top portions 351, 361, of the locking tabs, or near the score line on the top portions 351, 361. The first length of tape 66, one of the legs of the Y, would be adhered to the outer surfaces of tuck portions 352, 362 if the crotch of the Y is placed on score lines 353, 363. First length 66 would extend onto the outer surface of top portions 351, 361 if the crotch of the Y is placed away from score lines 353, 363 some distance onto the top portions. The second length of tape 67, the other leg of the Y, would be adhered to top portions 351, 361 of the locking tabs, and could optionally extend onto the top panel 313 for a more secure bond. The bonded mid-section 67*b* and second adhesive section 67*c* would be overlapped with the first length 66, which would thus act as release surface 80. Second adhesive section 67*c* can be peeled from the release surface 80 on the outer surface of tuck portions 352, 362 and then adhered to closure flaps 330, 340 to seal assembled container blank 310. If it is desired that an additional length of closure tape extend across the closure flaps 330, 340 onto bottom panel 311 to more securely seal the container, then first length 66 of the Y structure will continue around free edges 350*d*, 360*d* of each locking tab and onto the inner surfaces 350', 360', providing a longer release surface 80 allowing a longer portion 67*c* of the adhesive closure tape 60 to be releasably secured to release surface 80.

With respect to the three sided tube container blank 410 illustrated in FIGS. 19–21, tape structures 50 are used on two type of components of the container blank.

First, a panel closure tape structure 50 is mounted on third panel 413, making this the carrier panel. Adhesive tape 60 can be peeled back from the inner surface 413' of the third panel 413 as seen in FIG. 20 and securely adhered to first panel 411 to maintain the panels in a triangular configuration upon assembly, making first panel 411 the receiving panel. Two panel closure structures are illustrated in FIGS. 19 and 20, however more or less may be used as desired. As illustrated in FIG. 20, release surface 80 is located on the inner surface 413' of third panel 413, extending at least from free edge 413*b*, towards the score line 413*a* on the opposite edge of third panel 413. Release surface 80 should be long enough to releasably secure the length 60*y* of adhesive closure tape 60 which is necessary to adequately seal third panel 413 to first panel 411. That is, when the container blank 410 is assembled into a triangular, open ended tube box with third panel 413 adjacent to and overlapping inner panel 414, the length 60*y* of closure adhesive tape which was releasably secured to the inner surface of first panel 413 will now be securely adhered to the outer surface of first panel 411 beginning at score line 411*a*, and continuing across the first panel 411 towards score line 411*b*, as seen in FIG. 21.

Second, a closure flap tape structure is mounted on one or more closure flaps on each open end of the container. In FIG. 16, two such structures are illustrated at each end, one each on first and third closure flaps 421 and 423, and one each on fourth and sixth closure flaps 431, 433, making these the carrier flaps. When two tape structures are used on each end, second and fifth flaps 422 and 432 are the receiving flaps. It is also possible to use one carrier flap on each end rather than two. Tape structure 50 is mounted to first and third closure flaps 421, 423, such that adhesive closure tape 60 can be peeled back from the outer surface of each closure flap and securely adhered to the second closure flap 422 to seal the first opening 410*a* closed after the first and third closure flaps are folded over the opening, with the second closure flap folded over last as seen in FIGS. 20–21. Release surface 80 is located on the outer surface of fist and third closure flaps 421, 423, extending at least from score lines 411*c*, 413*c*, where the closure flaps are connected to the panels, towards the opposite edges of closure flaps 421, 423. Release surface 80 should be long enough to releasably secure the length 60*y* of adhesive closure tape 60 which is necessary to adequately seal second closure flap 422 over the first and third closure flaps 421, 423. That is, when the container blank 410 is assembled and closed, the lengths 60*y* of closure adhesive tape which were releasably secured to the outer surface of each of the first and third closure flaps 421, 423 will now be securely adhered to the outer surface of second closure flap 422 beginning at score lines 411*c*, 413*c* and continuing across the second closure flap 422. Corresponding tape structures are mounted on fourth and sixth closure flaps 431, 433 for securely adhering fifth closure flap 432 over the first-closed fourth and sixth closure flaps as seen in FIG. 21.

Tape structure 50 applied to container blank 410 can be of any of the embodiments described above with respect to the other container blanks. With respect to the closure flaps, closure adhesive tape 60 must extend from score lines 411*c*, 413*c*, where the closure flaps are connected to the panel, onto the first and third panels 411, 413 for a distance sufficient to prevent complete removal of tape 60 from container blank 410 when it is peeled back from release surface 80 on the closure flaps 421, 423 as seen in FIG. 19. Release surface 80 may be target tape 70 adhered to the outer surfaces of first and third closure flaps 421, 423, and fourth and sixth closure flaps 431, 433. Target tape 70 may be four individual lengths of tape, one per carrier flap, or may alternatively extend as a single length of tape from beyond score line 411*c* of the first closure flap, across the full length of first panel 411, to beyond score line 411*d* of the fourth closure flap, as would of closure tape 60, similar to the arrangement shown in FIG. 2 with respect to the RSC container blank 10. Likewise, a single length could extend from beyond score line 413*c* of third closure flap 423, across the full length of third panel 413, to beyond score line 413*d* of sixth closure flap 433. However, such an arrangement is prone to having the closure tape 60 completely removed from the container blank 310 during assembly, as discussed above. One way to minimize this risk would be to employ a closure tape 60 which is wider than the target tape 70 or laterally offsetting the closure tape 60 relative to target tape 70 and then folding or tucking the overhanging longitudinal edge of the closure tape 60 under the target tape 70 to form an adhesive-to-adhesive bond between the tapes 60 and 70 as seen in FIGS. 9*b* or 9*c*. The overlapping portion could be at the score lines 411*c*, 411*d*, 413*c*, 413*d*, or on the outer surface of first and third panels 411, 413.

Advantageously, release surface 80 will not extend beyond score lines 411*c*, 411*d*, 413*c*, 413*d*, onto the outer surface of first and third panels 411, 413. With such an arrangement, a length 60*w* of closure tape 60 will be directly adhered to the container blank 410 for a sufficient distance on the outer surface of the first and third panels 411, 413 to prevent the tape 60 from accidently being completely removed. A separate length of closure tape 60 could be used for each of the four carrier flaps. Alternatively, a single length extending from the release surface on the first closure flap 421, continuing across and securely adhered to the first panel 413, and ending on the release surface on the fourth closure flap 431, with a corresponding length extending from the third flap 423 to the sixth flap 433 across third panel 413. This arrangement would be similar to that shown in FIG. 4 with respect to RSC container blank 10.

With respect to the third panel 413, closure adhesive tape 60 must extend from free edge 413' onto the outer surface 413" of the third panel 413 for a distance sufficient to prevent complete removal of tape 60 from container blank 410 when it is peeled back from release surface 80 on inner surface 413'. Release surface 80 may be target tape 70 adhered to the inner surface 413' of first panel 413. Target tape 70 may extend beyond free edge 413*b* onto outer surface 413" of third panel 413, for the same length as closure adhesive tape 60. However, such an arrangement is prone to having the closure tape 60 completely removed from the container blank 410 during assembly, as discussed above. One way to minimize this risk would be to employ a closure tape 60 which is wider than the target tape 70 or laterally offsetting the closure tape 60 relative to target tape 70 and then folding or tucking the overhanging longitudinal edge of the closure tape 60 under the target tape 70 to form an adhesive-to-adhesive bond between the tapes 60 and 70 as seen in FIGS. 9*b* or 9*c*. The overlapping portion could be at the free edge 413*b*, or on the outer surface of third panel 413. Advantageously, release surface 80 will not extend beyond free edge 413*b* onto the outer surface 413" of third panel 413. With such an arrangement, a length 60*w* of closure tape 60 will be directly adhered to the container blank 410 for a sufficient distance on the outer surface of the third panel 413 to prevent the tape 60 from accidently being completely removed.

Another arrangement to minimize the risk of complete removal of adhesive closure tape 60 is the Y arrangement shown in FIGS. 5 and 6 with respect to RSC container 10 described above. One Y structure would be applied to each closure flap of container blank 410. Such an arrangement will be described with respect to first closure flap 421. The crotch of Y structure 65 would be placed at the score line 411*c* where the flap joins first panel 411, or near the score line on the first panel 411. The first length of tape 66, one of the legs of the Y, would be adhered to the outer surface of first flap 421 if the crotch of the Y is placed on the score line 411*c*. First length 66 would extend onto the outer surface of first panel 411 if the crotch of the Y is placed away from score line 411*c* some distance onto the first panel 411. The second length of tape 67, the other leg of the Y, would be adhered to first panel 411. The bonded mid-section 67*b* and second adhesive section 67*c* would be overlapped with the first length 66, which would thus act as release surface 80. Second adhesive section 67*c* can be peeled from the release surface 80 on the outer surface of first closure flap 421, and then adhered to second closure flaps 422 to seal assembled container blank 410. A Y structure could also be used for the panel tape structure mounted to third panel 413. The crotch of Y structure 65 would be placed at the edge 413*b*, or near the edge on the outer surface 413" of the third panel. The first length of tape 66, one of the legs of the Y, would be adhered to the inner surface 413' of third panel 413 if the crotch of the Y is placed on the score line 411*c*, and would extend onto the outer surface 413" if the crotch of the Y is set back from the free edge 413*b*. The second length of tape 67, the other leg of the Y, would be adhered to the outer surface 413". The bonded mid-section 67*b* and second adhesive section 67*c* would be overlapped with the first length 66, which would thus act as release surface 80. Second adhesive section 67*c* can be peeled from the release surface 80 on the inner surface 413' of third panel 413, and then adhered to first panel 411 to seal assembled container blank 410.

Backing

Tapes useful in the manufacture of this invention include those tapes having backings made of mono-axially and biaxially oriented polypropylene, oriented polyester, filament/fiber combinations, paper and the like.

Adhesive

The adhesive may be selected from any of the well known and widely available aggressive adhesives used with box closure tapes. The adhesive may be a heat-activated adhesive such as ethylene vinyl acetate adhesives (particularly those having a high vinyl acetate content of about 18–30 wt %); a water-activated adhesive such as a gummed adhesive; a pressure sensitive adhesive such as acrylate adhesives and tackified block copolymer adhesives; etc. Because of the ease with which such closure tapes 60 may be applied, the preferred adhesive is an aggressive pressure sensitive adhesive.

Particularly suitable pressure sensitive adhesive tapes for use as the closure tape 60 in the present invention include SCOTCH® brand tapes 373 and 375 available from the Minnesota Mining and Manufacturing Company of St. Paul, Mn.

Figure 7:
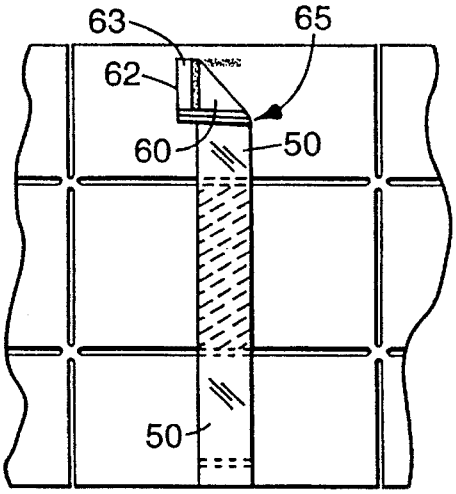
FIG. 7 is a plan view of a fourth embodiment of a tape structure which includes areas of pre-activated adhesive.

Closure tapes 60 using adhesives which do not possess any tack until activated, such as the gummed adhesives, must be activated in strategic locations during assembly of any of the above described pretaped container blanks so that the closure tape 60 will adhere to the container blank during shipping, handling and storage. The surface area of the closure tape 60 which is pre-activated must be strictly limited since the pre-activated areas will not be available for bonding to the carrier flaps, panels or tabs during assembly and oversized areas will tend to lift strips of paper from the container blank. One example of a suitable configuration is depicted in FIG. 7 where the width of the pre-activated lines is about 1 to 2 mm. Other suitable configurations include a dotted pattern of activated adhesive or the inclusion of a thin line of pressure sensitive adhesive.

Tab

The releasable end 62 of the closure adhesive tape 60 includes a releasable tab 63, also known as a lift tab or a finger tab, when a pressure sensitive adhesive is employed. The tab 63 prevents the releasable end 62 from adhesively bonding to the release surface 80 so that the releasable end 62 may be readily gripped for peeling of the closure adhesive tape 60 from the release surface 80. The tab 63 is preferably releasably bonded to the closure tape 60 so that the tab 63 may be removed after application of the closure adhesive tape 60 to the receiving flaps or panels and that portion of the closure adhesive tape 60 covered by the tab 63 also applied to the receiving flaps or panels. Suitable materials for use as the release tab 63 include silicone coated paper sheets or plastic films.

The releasable tab 63 may be eliminated by simply folding the releasable end 62 of the closure adhesive tape 60 back upon itself in adhesive-to-adhesive contact to create a nonadhesive tab 63 at the releasable end 62 of the closure tape 60. While this option is generally simpler, less expensive and generates less waste, it is only practical where the presence of a nonadhesive tab 63 extending from the completely assembled and sealed box is acceptable from both a functional and aesthetic standpoint. Numerous other options are also available including coating the adhesive at the releasable end 62 of the closure tape 60 with a de-tackifying agent such as wax or talc; covering the releasable end 62 of the closure tape 60 with printing ink; manufacturing closure tape 60 which does not coat the releasable end 62 of the closure tape 60 with adhesive 60*m;* etc. It is also possible to use a detachable tab 68 as shown in FIG. 22. With detachable tab 68, the user can grasp the unadhered tab to peel the closure tape 60 from the release surface 80. The detachable tab 68 can then be torn along weakened line 69 such as a score line or perforated line so that no unadhered portion of closure tape 60 extends from the closed and sealed container.

RELEASE SURFACE

A release surface 80 is required when a pressure sensitive adhesive tape is employed. The release surface 80 provides appropriate release characteristics so that the pressure sensitive adhesive on the closure tape 60 may be peeled from the release surface 80 without leaving an adhesive residue on the release surface 80 and without lifting fragments of the release surface 80 which would interfere with adhesive bonding of the closure tape 60 to the receiving flaps or panels.

Any material capable of forming a bond with the container blank which is sufficient to prevent delamination of the material from the container blank when the closure adhesive tape 60 is peeled from the material and possessing the release characteristics outlined above may be used to form the release surface 80. Suitable materials include target tapes and release coatings.

Target Tapes

Adhesive tapes used to form a release surface 80 are known as target tapes 70. Tapes suitable for use as a target tape 70 include tapes that adhere well to the container blank and have a backing surface from which an adhesive closure tape 60 will release without lifting of the target tape 70 from the container blank or leaving residual adhesive 60*m* on the target tape 70. Examples of suitable pressure sensitive adhesive tapes suitable for use as the target tape 70 in the present invention include the same SCOTCH® brand tapes disclosed above as suitable for use as the closure tape 60 in this invention.

Release Coating

A release coating can be applied to the carrier flap, panel or tab of the container blank to provide the desired release surface 80. The release coating provides a surface on the container blank with a reduced adhesive affinity for the pressure sensitive adhesive 60*m* on the closure tape 60.

Materials suitable as for use as the release coating include acrylates, fluorochemicals, polyethylenes, silicones, epoxy silicones, vinyl copolymers and combinations of these compounds. Additional compounds suitable for use as the release coating are disclosed in U.S. Pat. No. 4,728,571 issued to Clemens et al. One family of commercially available silicone release coatings are available from Dow Corning Corporation of Midland, Mi. under the mark SYL-OFF®. Preferred types of low adhesion backsize are the siloxane and acrylate based compounds disclosed in U.S. Pat. No. 4,973,513 issued to Riedel and the water-insoluble hydrophobic urethane (carbamate) copolymer of polyvinyl alcohol and octadecyl isocyanate disclosed in U.S. Pat. No. 2,532,011 issued to Dahlquist et al, both assigned to the Minnesota Mining and Manufacturing Company of St. Paul, Mn.

The release coating may be applied by any of the conventional water or solvent-based coating techniques including air knife, trailing blade, direct and offset gravure, Meyer bar, wire-wound rod, reverse roll, roll coating, print bond and spray coating.

When a low-adhesion backsize is employed to form the release coating, a dried coating weight of at least about 0.04 mg backsize per $cm^2$ container surface is generally effective for achieving the desired reduction in adhesion.

A final option available for providing the desired release characteristics with closure adhesive tapes 60 employing a pressure sensitive adhesive 60*m* is the use of a release liner (not shown) covering the adhesive 60*m*. The liner (not shown) would include a discontinuity such as a hole or slit (not shown) in the liner near the releasable end 62 of the closure tape 60 through which the adhesive 60*m* could adhere to the container blank and hold the closure tape 60 in position until the container blank is assembled. Because of the additional refuse generated by the need to remove and dispose of the liner (not shown) during assembly, this embodiment is not the embodiment of choice for most applications.

Any of the pretaped container blanks described herein may be rendered reusable by also mounting a release surface 80 over the surface of the receiving flaps or panels which will be contacted by the closure tape 60 when the container is assembled and sealed. For example, a release surface 80 can be added to side flaps 22*a*/24*a*/22*b*/24*b* of RSC blank 10 in the position where adhesive tape 60 is placed to seal the container closed. However, it must be remembered that incorporation of a release surface 80 on the receiving flaps or panels will decrease the strength of the adhesive bond between the closure tape 60 and the receiving flaps or panels and may not be suitable for those applications where maximum strength is required.

Assembling and Sealing the Container

Regular Slotted Container Blank

The free ends of the RSC container blank 10 are brought together and joined by means of the attaching flap 18 using a manufacturer's joint. The manufacturer's joint is formed by the manufacturer and may be achieved with taped joints, glued joints or wire-stitched joints. The jointed RSC container blank 10 may then be assembled into a three-dimensional container by (i) folding the end flaps 21*a*/23*a* towards each other until they form a flat surface relative to one another, (ii) peeling the releasable adhesive tape 60*y* from at least the entire length of each end flap 21*a*/23*a*, (iii) folding the side flaps 22*a*/24*a* over the folded end flaps 21*a*/23*a* to form a flat surface, and (iv) applying the lengths of adhesive tape 60*y* peeled from the end flaps 21*a*/23*a* over the seam (not shown) between the side flaps 22*a*/24*a* so as to connect the side flaps 22*a*/24*a* and close the first end of the container. Once the desired contents have been placed in the container the container may be sealed by simply repeating steps (i) through (iv) above for the second end of the container.

Die-Cut Diskette and Book Container Blank

The die cut container blank 110 is shown unassembled in FIG. 10, with the inside of the box shown face up. Thus, the steps of folding the blank described below will be made in the direction up out of the page to place the inside surfaces (shown face up in FIG. 10) of the panels facing one another. The die cut container blank 110 is assembled by first folding the side interior panels 140 which are attached to the front panel 111 along score lines 111*a* and 111*b*. When the side interior panels 140 are perpendicular to front panel 111 and parallel to one another, the front panel is then folded along score line 112*c* to be perpendicular to bottom panel 112, with bottom edges 141 of the side interior panels resting along score lines 112*a* and 112*b*. Similarly, the side interior panels 140 adjoining rear panel 113 are folded to be perpendicular to rear panel 113. Rear panel 113 is then folded along score line 112*d* to be perpendicular to bottom panel 112. The bottom edges 141 of all four side interior panels 140 will now be resting along score lines 112*a* and 112*b*, with pairs of opposed side edges 142 facing one another.

Left side panel 121 is now folded along score line 112*a* to be perpendicular with bottom panel 112 such that outer portion 122 is adjacent two of the interior side panels 140. Left side panel 121 is then folded over on itself along double score line 124 to place inner portion 123 parallel to and facing outer portion 122, with two interior side panels 140 sandwiched therebetween. Lastly, tab 125 is placed in slot 126. The same steps are performed for right side panel 131, concluding with tab 135 being placed in slot 136. The container will now remain in this partially assembled position, and can be loaded as desired.

Referring to FIG. 11, closure adhesive tape 60 is now peeled away from release surface 80 on inner surface 115' of front flap 115. Top flap 114 is folded along score line 114*c* to close the opening bounded by the front, back and side panels. At this point, insert flaps 116 are folded along score lines 115*a* and 115*b* to be perpendicular to front flap 115 and parallel to one another. As front flap 115 is folded along score line 114*d* to overlap front panel 111, one insert flap 116 is simultaneously inserted into the slot formed between outer portion 122 of left side panel 121 and the adjacent side interior panel 140, while the second insert flap 116 is inserted into the slot formed between outer portion 132 of right side panel 131 and the adjacent side interior panel 140. Closure adhesive tape 60 may now be secured to bottom panel 112 to seal the container as seen in FIG. 12.

Die-Cut Tuck In Container Blank

The die-cut tuck in container blank 210 is shown unassembled in FIG. 13 with the outside surfaces of the container shown face up. Thus, the folding steps described below will be performed to fold the container panels down into the page such that the inside surfaces of the panels (shown face down in FIG. 13) will face the inside of the assembled container. First, back panel 213 is folded along score line 213*a* to place the back panel 213 perpendicular to bottom panel 212. This fold will simultaneously fold the left side panel 221 along score line 223*b* and right side panel 231 along score line 233*b*. Next, left side panel 221 is folded along score line 213*c* to place bottom portion 222 adjacent bottom panel 212 and outer portion 223 perpendicular to back panel 213. This will simultaneously place score line 223*b* along free edge 212*a* of bottom panel 212. Likewise, right side panel 231 is folded along score line 213*d* to place bottom portion 232 adjacent bottom panel 212 and outer portion 233 perpendicular to back panel 213. This will simultaneously place score line 233*b* along free edge 212*b* of bottom panel 212. First edge 222*a* of the left side panel and first edge 232*a* of the right side panel will now be adjacent one another.

Next, left side interior panel 240 is folded along score line 211*b* to be perpendicular to front panel 211, and right side interior panel 242 is folded along score line 211*c* to be perpendicular to front panel 211 and parallel to left side interior panel 240. Then, front panel 211 is folded along score line 211*a* to place it perpendicular to bottom panel 212 and parallel to back panel 213. This will simultaneously place left side interior panel 240 adjacent to and inside outer portion 223 of the left side panel 221, with bottom edge 240*a* of left interior panel 240 along score line 223*b*. Likewise, right side interior panel 242 will now be adjacent to and inside outer portion 233 of right side panel 231, with bottom edge 242*a* of right interior panel 242 along score line 233*b*. Then, left side panel 221 is folded onto itself along double score line 223*a*. This places inner portion 224 of the left side panel parallel to and facing outer portion 223, with the left side interior flap 240 sandwiched therebetween. Tab 225 is inserted in slot 226 to lock the left side panel. Likewise, right side panel 231 is folded onto itself along double score line 233*a*. This places inner portion 234 of the right side panel parallel to and facing outer portion 233, with the right side interior flap 242 sandwiched therebetween. Tab 235 is inserted in slot 236 to lock the right side panel. The container is now ready to be loaded with the desired contents.

The container may now be closed and sealed as follows. Referring to FIG. 14, closure adhesive tape 60 is peeled away from the release surface 80 on outer surface 215" of tuck flap 215. Top flap 214 may now be folded along score line 213*b* to close the opening bounded by the front, back, and side panels 211, 213, 221, 231, placing top flap 214 parallel to and facing bottom panel 212. Simultaneously, tuck flap 215 is tucked inside the container placing it adjacent to front panel 211. Closure tape 60 may now be securely adhered to front panel 211 from free edge 211*d* towards score line 211*a* as seen in FIG. 15. If a longer piece of adhesive tape 60 is employed, it will continue past score line 211*a* and onto the bottom panel 212.

Die-Cut Locking Tab Container Blank

The die-cut locking tab container blank 310 is shown unassembled in FIG. 16 with the outside surfaces of the container shown face up. Thus, the folding steps described below will be performed to fold the container panels down into the page such that the inside surfaces of the panels (shown face down in FIG. 16) will face the inside of the assembled container.

First, the first bottom panel 311 and second bottom panel 315 are folded towards each other, until the second bottom panel 315 overlaps the first bottom panel 311, such that a rectangular container open at first end 310*a* and second end 310*b* is formed. The above step will cause score lines 311*a*, 313*a*, 313*b* and 315*a* all to form right angles, such that front panel 314 and back panel 312 are parallel to and facing one another across the top and bottom panels 313, 314, 315, and the top panel 313 is parallel to and facing second bottom panel 315. First bottom panel 311 will be adjacent to the second bottom panel on the outside of the assembled container.

Next, the first opening 310*a* is closed as follows. First end flap 321 is folded along score line 312*a* to place the first end flap perpendicular to back panel 312. Bottom edge 321*a* of first end flap 321 will be along score line 311*b* of the first bottom panel 311, and top edge 321*b* of the first end flap 321 will be along edge 313*c* of top panel 313. Similarly, second end flap 322 is folded along score line 314*a* to place the second end flap perpendicular to front panel 314. Bottom edge 322*a* of second end flap 322 will be along score line 311*b* of the first bottom panel 311, and top edge 322*b* of the second end flap 321 will be along edge 313*c* of top panel 313. Next, first tuck flap 331 is folded along score line 330*a* while first closure flap 330 is folded along score line 311*b*.

Tuck flap 331 is inserted in the slot formed between the top edges 321*b*, 322*b*, of the first and second end flaps and the top panel 313, and first closure flap 330 will cover the first opening 310*a*.

First closure flap 330 is then locked with the first locking lock tab 350 and sealed with the tape structure 50 mounted on the first locking tab. Top portion 351 of first locking tab 350 is folded along score line 350*a* away from the first closure flap 330 while tuck portion 352 is folded along score line 353 towards first closure flap 330. Adhesive closure tape 60 is peeled away from the outer surface 350" of first locking tab 350, so that locking portion 352 can be inserted in slot 332, thereby locking the first locking tab 350 and first closure flap 330 together. Adhesive closure tape 60 is then securely adhered to the first closure flap 330 beginning at score line 330*a* towards score line 311*b*.

With first opening 310*a* closed and sealed, the container may now be loaded with the desired contents. The same steps described for closing and sealing first opening 310*a* are now repeated to close and seal second opening 310*b* as seen in FIGS. 17–18.

Three-Sided Tube Container Blank

The three-sided tube container blank 410 is shown unassembled in FIG. 19 with the outside surfaces of the container shown face up. Thus, the folding steps described below will be performed to fold the container panels down into the page such that the inside surfaces of the panels (shown face down in FIG. 19) will face the inside of the assembled container.

First, the third panel 413 and inner panel 414 are folded towards each other, until the free edge 414 of the inner panel is adjacent score line 413*a*, such that a triangular container open at first end 410*a* and second end 410*b* is formed as seen in FIG. 19. Adhesive tape 60 is peeled back from the release surfaces 80 on inside surface 413' of the third panel 413 as seen in FIG. 20, and then third panel 413 is folded over to overlap inner panel 414. This will place free edge 413*b* of the third panel adjacent score line 411*a* which joins the inner panel 414 to the first panel 411, as seen in FIG. 21. Then adhesive tape 60 is securely adhered to second panel 411, beginning at score line 411*a* and extending towards score line 411*b*.

Next, the first opening 410*a* is closed as follows. The adhesive tape 60 is first peeled back from release surface 80 on first and third flaps 421, 423. First and third flaps 421 and 423 are then folded along score lines 421*c*, 413*c*, respectively to overlap one another and close first opening 410*a*. Then second flap 422 is folded along score line 412*a* to overlap the first and third flaps 421, 423. Second flap 422 must be folded after first and third flaps 421, 423, however it is not important which of the first and third flaps 421, 423 is folded over first. First end 410*a* is then sealed by securely adhering the adhesive tape from the first and third flaps 421, 423 onto second flap 422. The two lengths of adhesive tape will partially overlap one another, it is not important which is applied first.

With first opening 410*a* closed and sealed, the container may now be loaded with the desired contents. The same steps described for closing and sealing first opening 410*a* are now repeated to close and seal second opening 410*b* as seen in FIG. 21.

In addition to the aspects described herein, any of the container blanks may also include or be packaged with customary enhancements such as an address label, internal cushioning, etc.

The present invention has now been described with respect to several embodiments thereof. It will be apparent to those skilled in the art that many changes can be made in the embodiments described without departing from the scope of the present invention. For instance, any of the tape structure embodiments described herein may be applied to any of the container blank embodiments described herein. Furthermore, the tape structures described herein may be advantageously applied to any type of container, envelope, or package or the like in which one member is to be sealed against another member. Thus, the scope of the present invention should not be limited to the structures described in this application, but only by the structures described by the language of the claims and the equivalents of those structures.

What is claimed is:

1. A pretaped container blank for assembly into a three-dimensional container, comprising:

(a) a container blank including (i) a plurality of interconnected panels, including a first panel, a second panel and a receiving panel, wherein said second panel and said receiving panel are joined along a common score line, and (ii) a plurality of flaps, including a top flap hingedly connected at one edge thereof to said first panel, and a carrier flap hingedly connected at one edge thereof to said top flap, said carrier flap including an inner surface, an outer surface, and a free edge; and (b) a tape structure attached to said container blank and including (i) a release surface mounted on said inner surface of said carrier flap adjacent said free edge, and (ii) a length of closure adhesive tape, wherein a first portion of said closure adhesive tape is releasably adhered to said release surface and a second portion of the closure adhesive tape extends around said free edge and onto said outer surface of said carrier flap for a distance sufficient for said closure adhesive tape to remain attached to said container blank upon removal of said first portion from said inner surface of said carrier flap;

wherein, upon assembly of said container blank into a three dimensional container, said top flap is configured to close an opening bounded by said plurality of panels, said carrier flap is configured to overlay said second panel such that said inner surface is adjacent said second panel, and said first portion of said adhesive tape may be removed from said release surface and securely adhered to said receiving panel from said common score line and extending onto said receiving panel.

2. A pretaped container blank for assembly into a three-dimensional container, comprising:

(a) a container blank including (i) a plurality of interconnected panels, including a first panel and a receiving panel, and (ii) a plurality of flaps, including a carrier flap and a top flap including a first edge and a second edge, wherein said carrier flap is hingedly connected to said top flap at said first edge and said carrier flap includes an inner surface and an outer surface, and wherein said top flap is hingedly connected to said first panel at said second edge; and (a) a tape structure attached to said container blank and including (i) a release surface mounted on said outer surface of said carrier flap adjacent said first edge of said top panel, and (ii) a length of closure adhesive tape, wherein a first portion of said closure adhesive tape is releasably adhered to said release surface and a second portion of the closure adhesive tape extends beyond said first edge of said top flap and onto said top flap for a distance sufficient for said closure adhesive tape to remain attached to said container blank upon removal of said first portion from said outer surface of said carrier flap;

wherein, upon assembly of said container blank into a three dimensional container, said top flap is configured to close an opening bounded by said plurality of panels, said carrier flap is configured to overlay said receiving panel from inside said assembled container such that said outer surface is adjacent said second panel, and said first portion of said adhesive tape may be removed from said release surface and securely adhered to said receiving panel.

3. A pretaped container blank for assembly into a three-dimensional container, comprising:

(a) a container blank including (i) a plurality of interconnected panels, including a first panel and a second panel, said second panel including a first flap edge, (ii) a plurality of flaps, including a first closure flap and a first tuck flap, wherein said closure flap is hingedly connected to said second panel along said flap edge and said tuck flap is hingedly connected to said closure flap at a first tuck edge of said closure flap, and wherein a first tab slot is formed along a portion of said tuck edge, and (iii) a first locking tab, wherein said locking tab includes a first top portion hingedly connected to said first panel, and a first tuck portion hingedly connected to said top portion at a first tab score line and including an outer surface; and (a) a first tape structure attached to said container blank and including (i) a release surface mounted on said outer surface of tuck portion of said locking tab adjacent said tab score line, and (ii) a length of closure adhesive tape, wherein a first portion of said closure adhesive tape is releasably adhered to said release surface and a second portion of the closure adhesive tape extends beyond said tab score line and onto said top portion of said locking tab for a distance sufficient for said closure adhesive tape to remain attached to said container blank upon removal of said first portion from said outer surface of said tuck portion;

wherein, upon assembly of said container blank into a three dimensional container, said closure flap is configured to close a first opening bounded by said plurality of panels, said tuck flap is configured to overlay a portion of said first panel from inside said assembled container, said locking tab is configured such that said tuck portion may be inserted into said tab slot thereby locking said closure flap closed, and said first portion of said adhesive tape may be removed from said release surface and securely adhered to said closure flap beginning at said tuck edge and continuing onto said closure flap.

4. A pretaped container blank for assembly into a three-dimensional container, comprising:

(a) a container blank including (i) a plurality of laterally interconnected panels, each of said panels including a panel edge, respectively and (ii) a plurality of first closure flaps, including a first carrier flap and a first receiving flap, wherein each of said closure flaps is hingedly connected to a respective one of said panels along a respective one of said first panel edges; and (b) a first tape structure attached to said container blank and including (i) a first release surface mounted on said carrier flap adjacent said flap edge, and (ii) a first length of closure adhesive tape, wherein a first portion of said closure adhesive tape is releasably adhered to said release surface and a second portion of said closure adhesive tape extends beyond said first panel edge and onto. On adjacent one of said panels for a distance sufficient for said second closure adhesive tape to remain attached to said container blank upon removal of said first portion from said carrier flap;

wherein, upon assembly of said container blank into a three dimensional container said plurality of closure flaps are configured to fold along said first panel edges to thereby close an opening bounded by said plurality of first panel edges, with said receiving flap being the last closed of said closure flaps, and wherein said first portion of said closure adhesive tape may be removed from said release surface and securely adhered to said receiving flap.

5. A pretaped container blank for assembly into a three-dimensional container, comprising:

(a) a container blank including (i) a plurality of laterally interconnected panels, including an inner panel at a first side of said blank, a receiving panel hingedly connected to said inner panel, and a carrier panel at a second end of said blank, wherein said carrier panel includes an inner surface, an outer surface and a free edge, each of said panels including a panel edge, respectively and (ii) a plurality of first closure flaps, wherein each of said flaps is hingedly connected to a respective one of said panels along a respective one of said first panel edges; and (b) a first tape structure attached to said container blank and including (i) a first release surface mounted on said inner surface of said carrier panel adjacent said panel free edge, and (ii) a first length of closure adhesive tape, wherein a first portion of said closure adhesive tape is releasably adhered to said release surface and a second portion of the closure adhesive tape extends beyond said panel free edge and onto said outer surface of said carrier panel for a distance sufficient for said first closure adhesive tape to remain attached to said container blank upon removal of said first portion from said inner surface of said carrier panel;

wherein, upon assembly of said container blank into a three dimensional container, said carrier panel is configured to overlay said inner panel thereby forming a three dimensional container having a first opening bounded by said first panel edges, and said first portion of said first length of closure adhesive tape may be removed from said first release surface and securely adhered to said receiving panel, and wherein said plurality of closure flaps are configured to fold along said first panel edges to thereby close said first opening.

6. The pretaped container blank of claim 5, wherein:

(a) said plurality of first closure flaps includes a first carrier flap and a first receiving flap;

(b) said container blank further includes a second tape structure attached to said container blank and including (i) a second release surface mounted on said carrier flap adjacent said flap edge, and (ii) a second length of closure adhesive tape, wherein a first portion of said second length of closure adhesive tape is releasably adhered to said release surface and a second portion of said second length of closure adhesive tape extends beyond said first panel edge and onto an adjacent one of said panels for a distance sufficient for said second closure adhesive tape to remain attached to said container blank upon removal of said first portion from said carrier flap; and (c) upon assembly of said container blank into a three dimensional container said first closure flap and first receiving flap are configured to fold along said first panel edges to thereby close said first opening, with said first receiving flap being the last closed of said closure flaps, and wherein said first portion of said second length of closure adhesive tape may be removed from said second release surface and securely adhered to said first receiving flap.

* * * * *

UNITED STATES PATENT AND TRADEMARK OFFICE

CERTIFICATE OF CORRECTION

PATENT NO.: 5,503,325

DATED: April 2, 1996

INVENTOR(S): Thomas L. Nelson et al.

It is certified that error appears in the above-identified patent and that said Letters Patent is hereby corrected as shown below:

Col. 8, line 34, "240b" should read --340b--.

Col. 9, line 35, the first occurrence of "22b" should read --21b--.

Col. 9, line 53, the second occurrence of "12d" should read --13d--.

Col. 9, line 54, the second occurrence of "22a" should read --23a--.

Col. 9, line 55, the second occurrence of "12a" should read --13a--.

Col. 11, line 53, insert --315.-- between "panel" and "Back".

Col. 12, line 19, "320a, 320b," should read --310a, 310b--.

Col. 12, line 26, "form" should read --from--.

Col. 12, line 34, "form" should read --from--.

Col. 12, line 54, "40b" should read --410b--.

Col. 13, line 25, insert ''22b/24b-- between "or" and "together".

Col. 13, line 30, insert --10.-- after "blank".

Col. 15, line 3, insert --67-- after "tape".

Col. 15, line 56, "10" should read --110--.

UNITED STATES PATENT AND TRADEMARK OFFICE

CERTIFICATE OF CORRECTION

PATENT NO.: 5,503,325

DATED: April 2, 1996

INVENTOR(S): Thomas L. Nelson et al.

It is certified that error appears in the above-identified patent and that said Letters Patent is hereby corrected as shown below:

Col. 16, line 19, insert --110,-- between "blank" and "the".

Col. 19, line 21, insert --60-- between "tape" and "extend".

Col. 26, line 50, "314" should read --311--.

Col. 30, line 6, "onto. On" should read --onto an--.

Signed and Sealed this
Twenty-eighth Day of January, 1997

*Attest:*

Bruce Lehman

BRUCE LEHMAN

*Attesting Officer* *Commissioner of Patents and Trademarks*